US006831619B2

(12) United States Patent
Todokoro

(10) Patent No.: US 6,831,619 B2
(45) **Date of Patent: *Dec. 14, 2004**

(54) IMAGE-FORMING APPARATUS

(75) Inventor: Yasuyuki Todokoro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 09/994,782

(22) Filed: Nov. 28, 2001

(65) Prior Publication Data

US 2002/0053997 A1 May 9, 2002

Related U.S. Application Data

(62) Division of application No. 09/045,030, filed on Mar. 20, 1998.

(30) Foreign Application Priority Data

Mar. 21, 1997 (JP) ..... 9-068173

(51) Int. Cl.[7] ..... G09G 3/22
(52) U.S. Cl. ..... 345/74.1; 345/75.1; 345/75.2
(58) Field of Search ..... 345/74.1, 75.1, 345/75.2, 76, 77, 45, 46, 47

(56) References Cited

U.S. PATENT DOCUMENTS

| | | | | |
|---|---|---|---|---|
| 4,978,195 A | | 12/1990 | Takano et al. | 350/96.27 |
| 5,025,490 A | | 6/1991 | Tamura | 313/479 |
| 5,165,972 A | | 11/1992 | Porter | 428/1 |
| 5,430,459 A | * | 7/1995 | Clerc | 345/75.1 |
| 5,449,970 A | * | 9/1995 | Kumar et al. | 345/75.1 |
| 5,541,478 A | * | 7/1996 | Troxell et al. | 345/75.1 |
| 5,608,285 A | | 3/1997 | Vickers et al. | 345/75 |
| 5,659,328 A | | 8/1997 | Todokoro et al. | 345/74 |
| 5,940,052 A | | 8/1999 | Xia et al. | 345/74 |
| 5,945,969 A | * | 8/1999 | Westphal | 345/75.1 |
| 5,949,393 A | | 9/1999 | Sakai et al. | 345/74 |
| 6,011,356 A | | 1/2000 | Janning et al. | 315/169.4 |
| 6,034,480 A | | 3/2000 | Browning et al. | 315/169.1 |
| 6,144,351 A | * | 11/2000 | Zimlich | 345/74 |
| 6,181,308 B1 | * | 1/2001 | Cathey et al. | 345/75.2 |
| 6,184,851 B1 | | 2/2001 | Yamaguchi et al. | 345/75.2 |
| 6,195,076 B1 | * | 2/2001 | Sakuragi et al. | 345/74.1 |
| 6,249,266 B1 | * | 6/2001 | Kishino et al. | 345/75.1 |
| 6,252,569 B1 | * | 6/2001 | Hodson et al. | 345/75.2 |
| 6,313,815 B1 | * | 11/2001 | Takeda et al. | 345/75.2 |
| 6,342,875 B2 | * | 1/2002 | Todokoro | 345/74.1 |
| 6,473,063 B1 | * | 10/2002 | Suzuki et al. | 345/74.1 |

FOREIGN PATENT DOCUMENTS

| | | |
|---|---|---|
| JP | 9-27288 | 1/1997 |
| KR | 93-1116 | 1/1993 |

* cited by examiner

*Primary Examiner*—Regina Liang
*Assistant Examiner*—Kimnhung Nguyen
(74) *Attorney, Agent, or Firm*—Fitzpatrick, Cella, Harper & Scinto

(57) ABSTRACT

An image-forming apparatus includes an image-forming device in an envelope. The image-forming device includes a member (e.g., a thin film electrode) which is carried on the inner surface of the envelope and is adapted to application of electron-accelerating voltage Va. The member-carrying part, such as a transparent face plate, of the envelope also includes on its outer surface a structure for applying a voltage substantially equal to the voltage Va (e.g., an electroconductive layer connected to the thin-film electrode by way of a certain resistance). The electric field across the part is significantly reduced to thereby prevent migration of sodium ions contained in the part, which can be made of soda lime glass.

14 Claims, 19 Drawing Sheets

IMAGE-FORMING APPARATUS

This is a divisional application of application Ser. No. 09/045,030, filed on Mar. 20, 1998.

BACKGROUND OF THE INVENTION

1. Field of the Invention

This invention relates to an image-forming apparatus such as image display apparatus and, more particularly, it relates to the configuration of the face plate thereof.

2. Related Background Art

Intensive technological efforts are being paid to realize an ever larger display screen for image-forming apparatus comprising a cathode ray tube or CRT. The efforts are generally directed to technological problems to be resolved in order to reduce the depth, the weight and the cost of the apparatus.

The inventor of the present invention has been engaged in technological research on multiple electron beam sources and image-forming apparatus using them that can be realized by arranging a large number of surface conduction electron-emitting devices particularly in terms of materials, manufacturing method and structure.

FIG. 16 of the accompanying drawings schematically illustrates a wiring arrangement applicable to a multiple electron beam source proposed by the inventors of the present invention. Such a multiple electron beam source comprises a large number of surface conduction electron-emitting devices arranged two-dimensionally and provided with a simple matrix wiring arrangement as shown.

Referring to FIG. 16, reference numeral 4001 denotes surface conduction electron-emitting devices that are illustrated only schematically and reference numeral 4002 denotes row-directional wires, whereas reference numeral 4003 denotes column-directional wires. Note that the illustrated matrix has only 6 rows and 6 columns for the purpose of simplicity and convenience, although the number of wires will be selected to make the apparatus display intended images.

FIG. 17 is a partially cut out schematic perspective view of a cathode ray tube realized by using such a multiple electron beam source and comprising an envelope bottom 4005 provided with a multiple electron beam source 4004, an envelope frame 4007 and a face plate 4006 having an fluorescent layer 4008 and a metal back 4009. A high voltage is applied to the metal back 4009 of the face plate 4006 from a high voltage source 4010 by way of a high voltage introducing terminal 4011.

In a multiple electron beam source comprising surface conduction electron-emitting devices and provided with a simple matrix wiring arrangement, electric signals are applied appropriately and selectively to the row-directional wires 4002 and the column-directional wires 4003 in order to make the devices emit electrons in a desired manner. For example, when the surface conduction electron-emitting devices of a selected row of the matrix are driven, a selection voltage Vs is applied to the row-directional wire 4002 of the selected row and a non-selection voltage Vns is applied to the row-directional wires 4002 of the unselected remaining rows simultaneously. Then, a drive voltage Ve is synchronously applied to the column-directional wires 4003 to make the selected devices emit electron beams. With this technique, a voltage of Ve–Vs is applied to all the surface conduction electron-emitting devices of the selected row, whereas a voltage of Ve–Vns is applied to all the surface conduction electron-emitting devices of the unselected rows. Thus, by selecting appropriate values for voltages Ve, Vs and Vns, only the surface conduction electron-emitting devices of the selected row emit electron beams with a desired intensity. The surface conduction electron-emitting devices of the selected row can be made to emit electron beams with different respective intensities by varying the drive voltage Ve for each column-directional wires. Since surface conduction electron-emitting devices respond very quickly, the time during which electron beams are emitted from the surface conduction electron-emitting devices can be controlled by controlling the time for applying the drive voltage Ve.

Then, electron beams emitted from the multiple electron beam source 4004 are made to irradiate the metal back 4009 to which a high voltage is applied and energize the fluorescers to emit light. Therefore, an image-forming apparatus comprising such a multiple electron beam source can be made to display desired images by applying appropriate voltage signals to it in a controlled manner.

In the above described image-forming apparatus, the face plate 4006, the bottom of the envelope 4005 and the frame of the envelope 4007 are typically made of soda lime glass because then the envelope can be assembled without any difficulty.

When a high voltage is applied to the inner surface of the face plate 4006, a light electric current can flow from the inner surface to the outer surface of the face plate due to the electric field generated between the inner surface and the electric potential of the ground GND surrounding the apparatus. This is the electric current that flows as sodium (Na) atoms in the soda lime glass of the face plate 4006 are positively ionized and move. As Na cations move and get to the outer surface of the face plate 4006, some of them are deposited on the surface to make the face plate 4006 show a coarse surface. Some of the deposited Na cations can react with moisture in the air to produce sodium hydroxide and make the surface opaque. Then, the face plate 4006 will lose its optical transmissivity and contrast to a significant extent to consequently degrade the quality of the images displayed on the display screen. The migration of Na ions can also degrade the withstand voltage of the face plate.

Additionally, as the electric potential of the outer surface of the face plate 4006 rises, dirt can adhere to the surface to also degrade the quality of the images displayed on the screen. The electric potential of the inner surface of the face plate can also be changed by the raised potential of the outer surface. The viewer or observer of the display screen can become a victim of electric discharges that can take place when he or she gets closer to the face plate.

According to a known technique to eliminate the above problem, a transparent anti-charge film 4012 is formed on the surface of the face plate 4006 and grounded as shown in FIG. 18 to prevent the electric potential of the surface of the face plate.

However, with a glass face plate 4006 provided with an anti-charge film 4012 formed on the surface and grounded, a large potential difference of Va is produced between the front surface and the rear surface of the face plate 4006 when the high voltage Va is applied to the metal back 4009 arranged on the rear surface of the face plate as target of cathode rays. If the face plate is made of soda lime glass containing Na to a large concentration, Na cations inside the glass can move and become deposited on the grounding electrode side or the side of the anti-charge film 4012 when the high voltage Va is applied for a prolonged period of time regardless of the provision of the anti-charge film 4012.

This problem may be avoided by selecting a glass plate having a thickness of several centimeters for the face plate to reduce the field strength and slow down the moving rate of Na cations or using glass containing Na to a very low concentration for the face plate. However, the use of a face plate as thick as several centimeters will make the image-forming apparatus comprising such a face plate very heavy while the use of glass containing little Na will be a costly choice.

An alternative technique for avoiding the problem may be the use of a protector plate made of resin that is lightweight relative to glass and arranged on the glass face plate to reduce the voltage applied to the face plate.

SUMMARY OF THE INVENTION

Therefore, an object of the present invention is to provide an image-forming apparatus such as image display apparatus that can display images without degradation with time of the quality of displayed images.

Another object of the invention is to provide an image-forming apparatus that can display images without degradation with time of the optical transmissivity of the image-forming side (face plate side) of the apparatus.

Still another object of the invention is to provide an image-forming apparatus that is lightweight and can be manufactured at low cost.

According to the invention, there is provided an image-forming apparatus comprising an envelope and an image-forming means having a member adapted to application of voltage Va, characterized in that the member carrying on the inner surface thereof said member adapted to application of voltage Va and constituting part of the envelope also carries a means for applying a voltage substantially equal to said voltage Va.

DETAILED DESCRIPTION OF THE PREFERRED EMBODIMENTS

The present invention is based on the following findings relating to the above described prior art.

Firstly, when a voltage of 10 kV is applied to a 3 mm thick soda lime glass panel heated to 60° C. for 100 hours (a condition corresponding to the application of the voltage for several thousand hours at room temperature), optical transmissivity will fall to about 60% of the initial value at the end of the time. When the surface of the glass plate was observed by means of ESCA and XPS, the deposit on the surface was found to contain sodium carbonate as principle ingredient.

It was also found that the reduction in the transmissivity due to the reaction product of sodium occurs not evenly on the entire surface where the voltage is applied but rather irregularly. In the case of known image-forming apparatus, the irregularity becomes conspicuous and the quality of the displayed image is degraded remarkably when the reduction in the transmissivity exceeds about 10% in average. Thus, the reduction in the transmissivity should be suppressed to less than 10%.

The optical transmissivity is reduced by about 10% when a voltage of 10 kV is applied to a 3 mm thick soda lime glass plate at room temperature for about 300 hours. The volume of deposited sodium is substantially proportional to the applied voltage so that the quality of the displayed image will be remarkably degraded by the deposit of sodium at the end of 30 thousand hours when a voltage of 100 V is applied to a 3 mm thick soda lime glass plate.

Figure 19A:
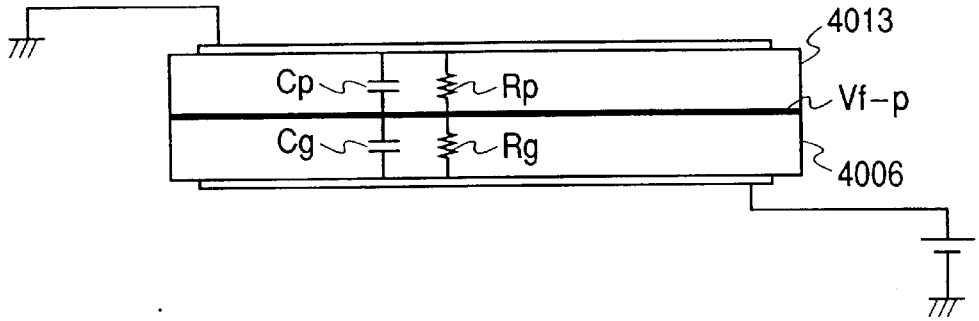
FIGS. 19A, 19B and 19C are schematic illustrations of the problem that arises when no potential interlocking electroconductive layer is used.

Referring to FIG. 19A, a protector plate 4013 made of resin that is lightweight relative to glass and arranged on the glass face plate 4006 can reduce the voltage applied to the face plate. (Note that the fluorescent layer is omitted in FIG. 19A for the purpose of simplicity.)

Figure 19B:
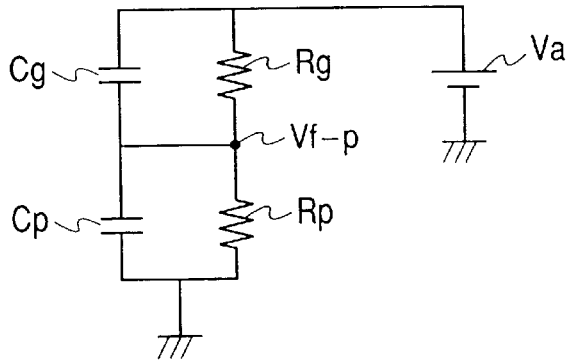

FIG. 19B shows a circuit diagram of an equivalent circuit of the arrangement of FIG. 19A, where the resistance and the capacitance of the glass face plate and the protector plate are Rg, Cg, Rp and Cp respectively. Note that in the equivalent circuit of FIG. 19B, it is assumed that the protector plate 4013 and the glass face plate 4006 can be electrically connected without problem. In other words, they are held in contact evenly and a same and equal electric potential prevails the entire interface. While a certain gap may be found between them or an adhesive layer may exist along the interface, they may be regarded as part of the parameters of the protector plate and hence the equivalent circuit of FIG. 19B will hold true if the capacitance and the resistance of the gap and/or the adhesive layer are taken into consideration.

Figure 19C:
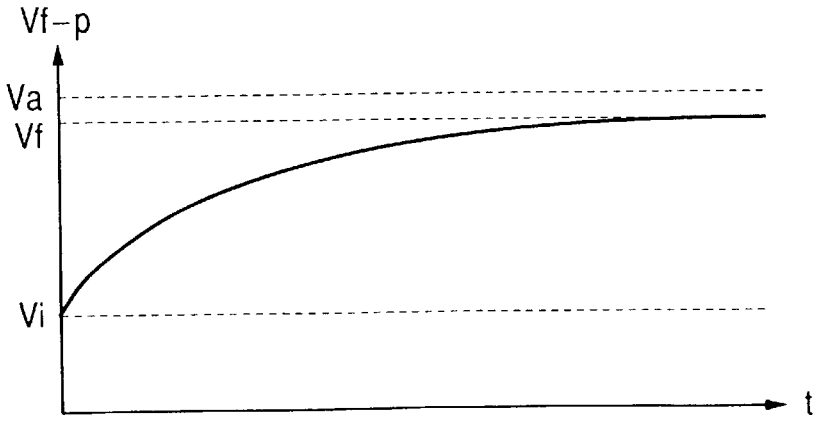

FIG. 19C shows the electric potential Vf-p at the middle of the glass face plate and the protector plate. Referring to FIG. 19C, initially it will be equal to Vi that is defined by the dielectric constant $\in g$ of the glass face plate, the dielectric constant $\in p$ of the protector plate, the thickness Tg of the glass face plate and the thickness Tp of the protector plate and expressed by equation (1) below.

$$Vi=Va\times Cg/(Cp+Cg)=Va\times 1/(1+\in g\times Tp/\in p\times Tg) \quad (1)$$

As time goes on, the electric potential Vf—p will come close to Vf that is defined by the volume resistivity ρg of the glass face plate and the volume resistivity ρp of the protector plate and expressed by equation (2) below.

$$Vf=Va\times Rp/(Rp+Rg)=Va\times(\rho p\times Tp)/(\rho p\times Tp+\rho g\times Tg) \quad (2)$$

The time constant τ is expressed by equation (3) below.

$$\tau=(\rho g\times Tg\times\rho p\times Tp)/(\rho g\times Tg+\rho p\times Tp)\times(\in p/Tp+\in g/Tg)\times\in O \quad (3)$$

When soda lime glass is used for the glass face plate 4006 and acryl or polycarbonate is used for the protector plate 4013, their volume resistivities ρg and ρp will be respectively $10^{12}$ to $10^{14}$ and $10^{15}$ to $10^{17}$ Ω·cm and their dielectric constants $\in g$ and $\in p$ will be 7 to 8 and 2 to 3 respectively, whereas $\in O$ will be 8.8 pF/m. If the both plates have a same thickness (Tg=Tp), Vf–p will start with the initial value of Vi=(0.6 to 0.7 times of Va) and gradually rises close to Vf.

In order to prevent the quality of the displayed image from being degraded by sodium migration in the soda lime glass if the image-forming apparatus is driven for tens of several thousand hours at room temperature, the electric field to be applied to the soda lime glass should be held to less than 10 V/mm. The voltage applied to the glass face plate is expressed by Va-(Vf–p) and, if Va is between several kV and 10 kV from the above equation, the initial value Vi of the voltage applied to the soda lime glass should be made close to Va when the time constant τ is very large whereas the value of convergence Vf should be made close to Va when the time constant τ is relatively small. To make Vi close to Va, it will be understood from equation (1) that either the thickness Tg of the glass face plate 4006 should be made very small or the thickness Tp of the protector plate 4013 should be made very large.

However, it will not be possible to reduce the thickness of the glass face plate below 2 mm if it is to withstand the atmospheric pressure. On the other hand, the thickness Tp of the protector plate will become very large relative to the thickness Tg of the glass face plate only when Tg and Tp are found somewhere around 2 mm and 400 mm thick respectively. The use of such a protector plate will not feasible for a thin image-forming apparatus and can make the apparatus very heavy. It will not be realistic either from the viewpoint of the optical transmissivity of the protector plate.

Now, the present invention that is achieved on the basis of the above findings will be described by way of embodiments.

An image-forming apparatus according to the invention comprises a means for applying a voltage substantially equal to Va arranged on the outer surface of the envelope member (face plate) to the inner surface of which Va is applied.

The face plate of the above embodiment is made of a material whose optical transmissivity falls with time as a voltage is applied thereto. A typical example of the material that can be used for the face plate is soda lime glass containing sodium.

The means for applying a voltage substantially equal to Va in the above embodiment includes a potential interlocking electroconductive layer arranged on the outer surface of the face plate. When a voltage substantially equal to Va is applied to the electroconductive layer, the electric potential of the outer surface of the face plate is potentially interlocked with Va.

For the purpose of the invention, a voltage substantially equal to Va is a voltage equal to or close to Va that is applied to the inner surface of the face plate and the potential difference across the face plate is preferably 0 V or less than 10 V.

In the embodiment of image-forming apparatus, the viewer or observer of the display screen can be prevented from touching the potential interlocking electroconductive layer where a high voltage is applied by arranging a transparent protector layer on the face plate. The transparent protector layer may well be in the form of a plate.

The embodiment of image-forming apparatus is additionally provided with an anti-charge film arranged on the surface of the protector plate to prevent dirt from adhering to the surface and prevent the viewer or observer of the display screen from becoming a victim of electric discharges.

In the embodiment of image-forming apparatus, the potential interlocking electroconductive layer is connected to the electrode on the inner surface of the face plate by way of an electroconductive member with electric resistance of r, which electric resistance r is sufficiently smaller than the electric resistance R between the anti-charge film on the surface of the transparent protector plate and the potential interlocking electroconductive layer. Additionally, the electric resistance r is such that, when voltage Va is applied to the electroconductive member, the electric current Va/r that flows due to the voltage is smaller than 1 mA.

Alternatively, the potential interlocking electroconductive layer may be a transparent electroconductive layer. Still alternatively, the potential interlocking electroconductive layer may be a black electroconductive member having a large number of fine pinholes, making itself to show a specific numerical aperture. Still alternatively, the potential interlocking electroconductive layer may be a transparent electroconductive layer arranged on the rear surface of the transparent protector plate. Still alternatively, the potential interlocking electroconductive layer may be a transparent electroconductive film formed on the surface of the glass face plate. Still alternatively, the potential interlocking electroconductive layer may be an electroconductive transparent adhesive layer.

The embodiment of image-forming apparatus additionally comprises a multilayer film on the surface of the protector plate that operates as anti-reflection film for external light to give rise to an anti-glaring effect.

In the embodiment of image-forming apparatus having a configuration as described above, the interlocking potential of the potential interlocking electroconductive layer arranged between the glass face plate and the transparent protector plate is made equal to the high voltage applied to the target of cathode rays. Alternatively, the potential difference applied across the face plate may be suppressed to a level that would not cause Na ions in the face plate to migrate so that the optical transmissivity of the face plate would not be reduced by migration of Na ions in the course of tens of several thousand hours of operation of the image-forming apparatus.

Additionally, since the transparent resin protector plate can withstand high voltages far better than the soda lime glass substrate and does not contain sodium, the above identified problem of losing transparency does not occur if it is made thin and a high voltage is applied to it. Therefore, it would not give rise to any problem to the image-forming apparatus in terms of weight and depth.

Still additionally, the potential interlocking layer blocks electromagnetic waves leaking from the cathode lay tube system and prevents the human body and the equipment located nearby from being affected by such waves.

Still additionally, the protector layer can offer the anti-explosion effect of preventing debris of the glass face plate from scattering if the latter is broken for some reason or another. Still additionally, the protector layer can provide the effect of reducing the loss of contrast of the displayed image due to reflection of external light of the glass face plate.

The electric potential of the potential interlocking layer can be interlocked with the applied high voltage by providing the potential interlocking electroconductive layer with a drawn-out wire and connecting it to the high voltage lead-in terminal of the high voltage source for applying a high voltage to the target of cathode rays that may be an aluminum metal back. The drawn-out wire may be replaced by a conductor such as a via hole or an electroconductive film with electric resistance r that connects the target of cathode rays and the potential interlocking layer.

Generally speaking, an electric current of several milliamperes is believed to give pain to the human body. Therefore, the electric current limiting means suppresses the electric current that can flow into the human body to a level lower than several milliamperes if a person touches the potential interlocking layer by mistake.

EXAMPLE 1

Firstly, the configuration of the face plate of the image-forming apparatus prepared in this example will be described by referring to FIG. 1.

An about 20 $\mu$m thick fluorescent layer 1008 is arranged on the inner surface of a 3 mm thick face plate 1006 made of soda lime glass and an aluminum metal back layer 1009 is formed thereon to cover the fluorescent layer to a thickness of about 1,000 angstroms. A high voltage lead-in terminal 1010 is connected to the aluminum metal back 1009.

Figure 21:
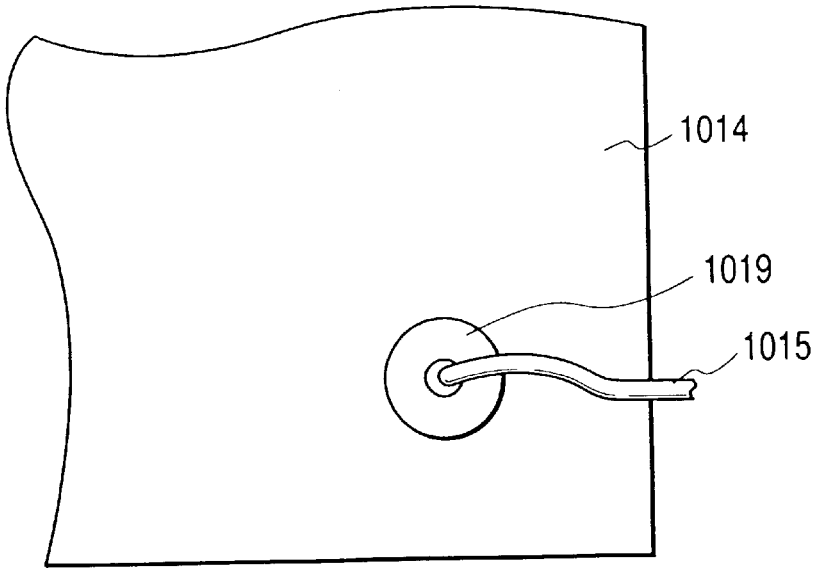
FIG. 21 is an enlarged schematic view of the wire drawing out section of the image-forming apparatus of Example 1.

An electroconductive film 1019 of a mixture of fine particles of ruthenium oxide and glass is formed between the potential interlocking electroconductive layer 1014 and the drawn-out wire 1015 as a thick film resistor having a film resistance of about $10^9\Omega/\square$. The resistance between the potential interlocking layer and the drawn-out wire 1015 was about $10^9\Omega$. While a mixture of fine particles of ruthenium oxide and glass was used as a thick film resistor in this example, the material of the resistor is not limited thereto and any material can be used so long as it provides the effect of limiting the electric current to an intended level. Thus, the thick film resistor may alternatively be realized by forming a film of an electrically highly resistive material such as Ta—Si—O or Ta—Ti—Nt by sputtering. FIG. 21 shows a plan view of an area where the potential interlocking layer 1014, the electroconductive film 1019 and the drawn-out wire 1015 are connected. The drawn-out wire 1015 is connected to a high voltage lead-in terminal 1011. The high voltage lead-in terminal 1011 is then connected to a high voltage source 1010 so that a high voltage, 10 kV in this example, can be applied between the aluminum metal back (target of cathode rays) 1009 and the potential interlocking layer 1014.

Figure 1:
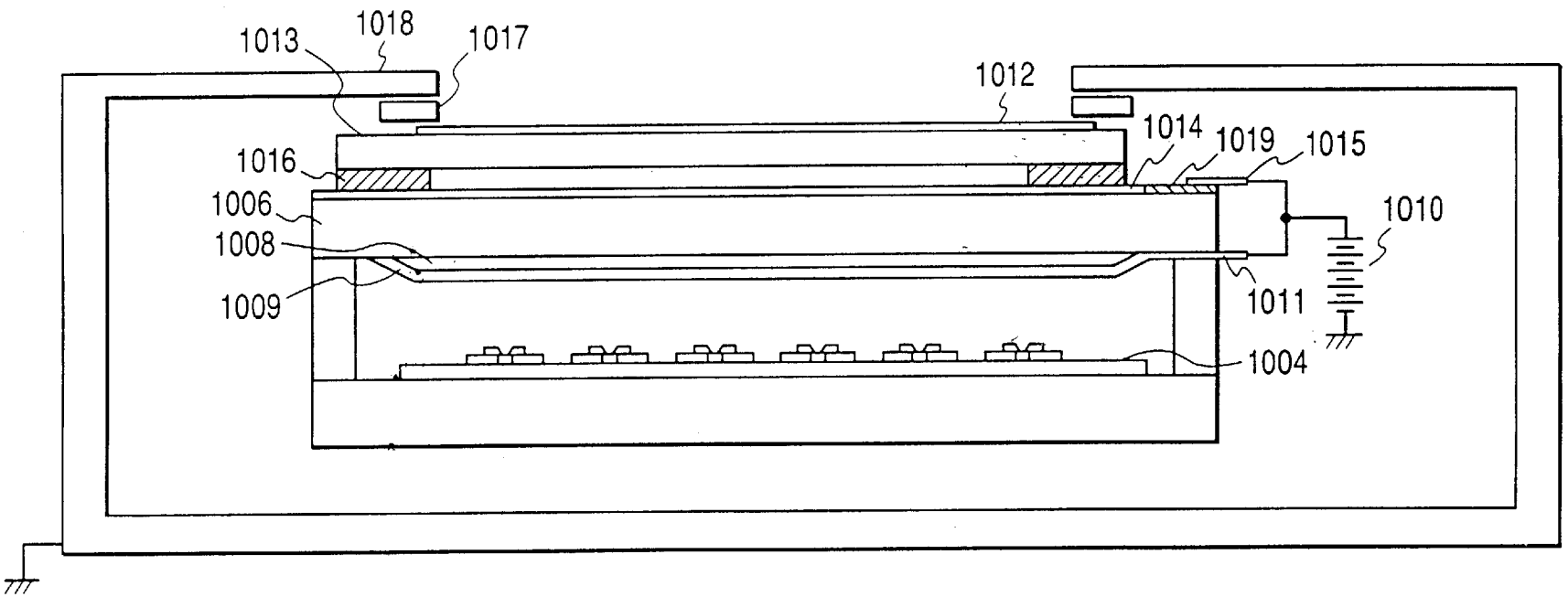
FIG. 1 is a schematic cross sectional view of the image-forming apparatus prepared in Example 1.

Reference numeral 1013 in FIG. 1 denotes a 3 mm thick protector plate made of acryl (PMMA), on which an anti-charge film 1012 of electroconductive transparent ITO is formed by evaporation.

While the transparent potential interlocking electroconductive layer 1014 and the anti-charge film 1012 are made of ITO and formed by evaporation in the above description, they may alternatively be a tin oxide or indium oxide film made by evaporation, or by applying a solution containing such a material and heating to form the film layers.

When the high voltage source is set on, the potential of the potential interlocking layer approaches the high potential with a time constant based on the capacitance C of the above-mentioned protector plate and the resistance r of the electroconductive film 1019, that is, on each on/off of the power source, the potential differs between the two surfaces of the face plate 1006 made of soda lime glass for a certain time period. In this example, however, the capacitance C of the protector plate is about 2000 pF, and the resistance R of the electroconductive film 1019 is $10^9\Omega$, so that the duration of potential difference between the two surfaces of the face plate is only about 1 second. Thus, with such a short time, Na deposition will not affect the light transmittance.

The anti-charge film 1012 is connected to the cabinet 1018 by way of pieces of electroconductive rubber 1017 and the cabinet 1018 is grounded. Thus, the electric potential of the surface of the protector plate is held to that of the ground and the surface is prevented from being electrically charged. The protector plate 1013 is rigidly held to the glass face plate 1006 by means of a 1 mm thick adhesive layer 1016. While a high voltage is applied to the potential interlocking layer 1014, dust gathering can be effectively prevented by hermetically sealing the layer.

The electric resistance of the anti-charge film is between $10^2$ and $10^3\Omega/\square$ and has an effect of blocking electromagnetic waves leaking from the inside of the image-forming apparatus not to affect the human body and the equipment located nearby.

Now, the process of manufacturing the display panel of an image-forming apparatus that can be used for the purpose of the invention will be described.

Figure 2:
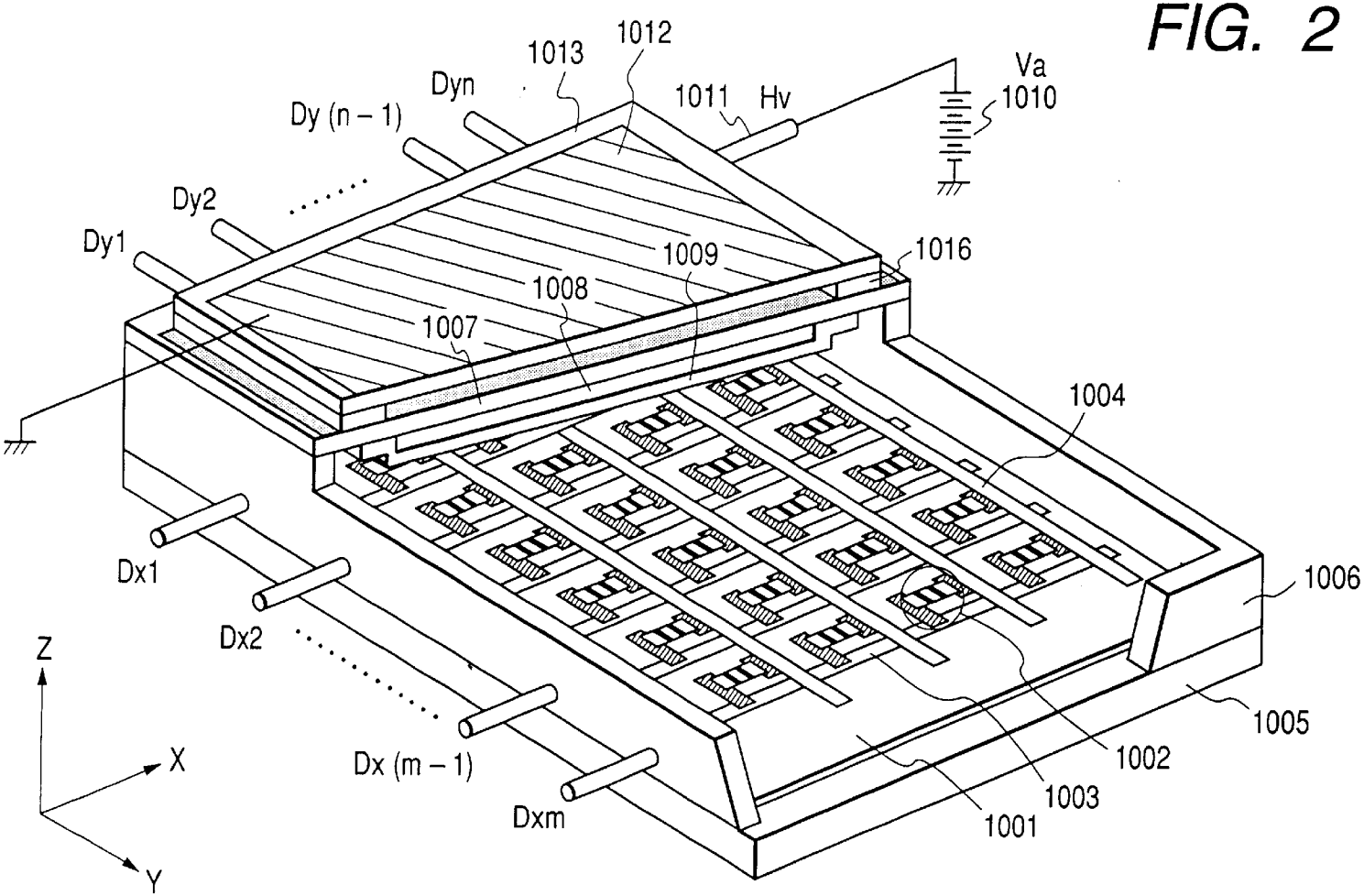
FIG. 2 is a schematic perspective view of the image-forming apparatus of Example 1, showing the inside by partly cutting out the display panel.

FIG. 2 is a schematic perspective view of the display panel of this example, the panel being partly cut out to show the inside.

Referring to FIG. 2, it comprises a bottom 1005 (also referred to as rear plate), lateral walls 1006 and a face plate 1007, the components 1005 through 1007 constituting the airtight envelope of the display panel for maintaining the inside of the display panel to an enhanced level of vacuum.

For assembling the airtight envelope, the members have to be firmly bonded to provide the junctions with strength and air-tightness to a sufficient degree. In this example the members were hermetically bonded by applying frit glass to the junctions and baking it in the atmosphere or in a nitrogen atmosphere at 400 to 500° C. for more than 10 minutes. Techniques that can be used for evacuating the inside of the airtight envelope will be discussed later.

An ITO film (potential interlocking electroconductive film) 1014 is formed on the surface of the face plate 1007 by evaporation. Then, a protector plate 1013 having an anti-charge film 1012 is securely arranged thereon with an adhesive layer 1016.

The rear plate 1005 is rigidly secured to a substrate 1001 and a total of M×N surface conduction electron-emitting devices 1002 are arranged on the substrate. (M and N represent positive integers equal to or greater than 2 selected according to the number of pixels used in the display panel. For example, N=3,000 and M=1,000 will be minimal for a high definition TV set. In this example, N=3,072 and M=1,024 were used.)

The N×M surface conduction electron-emitting devices are provided with a simple matrix wiring arrangement using M row-directional wires 1003 and N column-directional wires 1004. The unit formed by the components 1001 through 1004 is referred to as multiple electron beam source. The method of manufacturing a multiple electron beam source and its configuration will be described in detail later.

In this example, the substrate 1001 of the multiple electron beam source was rigidly secured to the bottom (rear plate) 1005 of the airtight envelope, but the substrate 1001 of the multiple electron beam source may be used to operate as the rear plate of the airtight envelope if it provides a sufficient degree of strength.

A fluorescent film 1008 is formed on the lower surface of the face plate 1007. Since the display panel of this example is a color display apparatus, fluorescers of three primary colors of red (R), green (G) and blue (B), commonly used for CRT are applied in stripe-shape to the area of fluorescent film 1008. The stripes of R, G and B fluorescers are separated by black electroconductive members 3010. Black electroconductive members 3010 are arranged for a color display panel to prevent the color aberration as small as possible when electron beams slightly miss the target, or the contrast reduction of displayed images due to reflected external light by blackening the surrounding areas. They can also prevent the fluorescent film from being electrically charged up.

While graphite is normally used as principal ingredient of the black electroconductive members 3010, some other conductive material that can achieved the above objectives may alternatively be used.

Figure 3A:
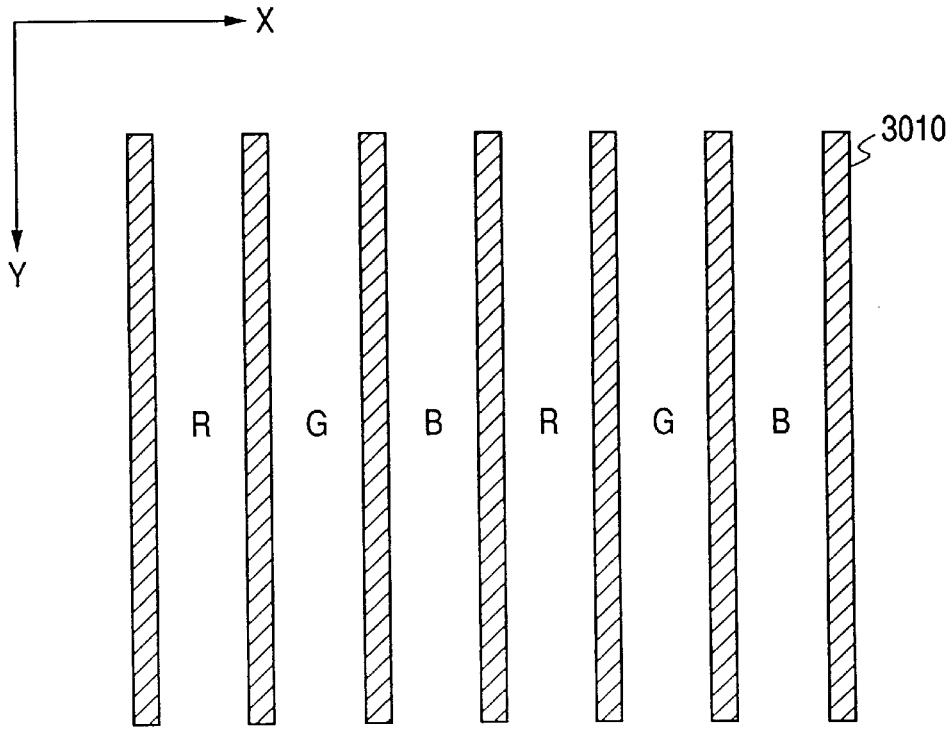
FIGS. 3A and 3B illustrate two alternative arrangements of fluorescers that can be used for the face plate of the display panel of an image-forming apparatus according to the invention.
Figure 3B:
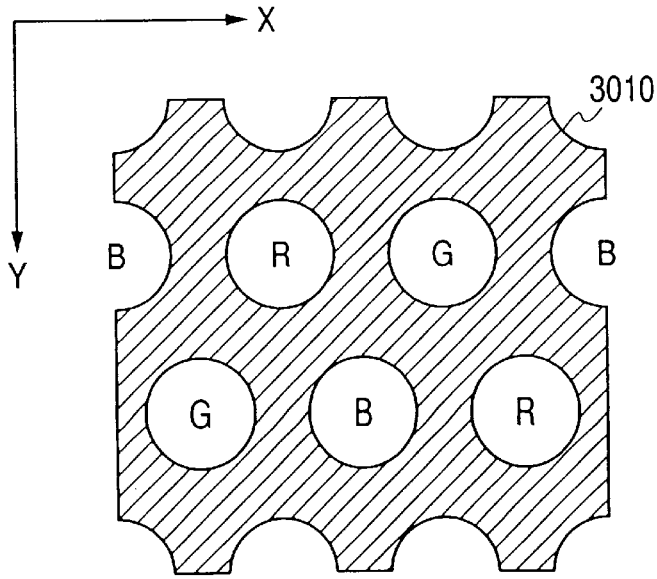

Fluorescers of three primary colors may be arranged into stripes as shown in FIG. 3A or, alternatively, they may be arranged into deltas as shown in FIG. 3B or in some other way.

If the display panel is for displaying monochromatic images, monochromatic fluorescers will be used for the fluorescent film 1008. Then, a black electroconductive material may not necessarily be used.

A metal back 1009 of the type known in the field of CRTs is arranged on the inner surface of the fluorescent film 1008. The metal back 1009 is provided in order to enhance the luminance of the display panel by causing the rays of light emitted from the fluorescent bodies and directed to the inside of the envelope to be mirror reflected, to protect the fluorescent film 1008 from negative ions trying to collide with it, to use it as an electrode for applying an accelerating voltage to electron beams and to operate the fluorescent film 1008 as a guide way for energized electrons. It is prepared by smoothing the inner surface of the fluorescent film 1008 arranged on the face plate substrate 1007 in a filming operation and forming an Al film thereon by vacuum evaporation. Note that the metal back 1009 is not used if a fluorescent material adapted to low voltages is used for the fluorescent film 1008.

While not used in this example, a transparent electrode typically made of ITO may be arranged between the face plate substrate 1007 and the fluorescent film 1008 to improve the electroconductivity of the fluorescent film and the efficiency of application of the acceleration voltage.

The display panel is connected to external circuits via terminals Dx1 through Dxm, Dy1 through Dyn and high voltage terminal Hv, which is an airtight terminal structure for connecting the display panel to an electric circuit (not shown). The terminals Dx1 through Dxm are connected to the row-directional wires 1003 and the terminals Dy1 through Dyn are connected to the column-directional wires 1004 of the multiple electron beam source, while Hv is connected to the metal back 1009 of the face plate.

To evacuate the inside of the airtight envelope, the exhaust pipe of the assembled envelope (not shown) is connected to a vacuum pump. The inside of the envelope is evacuated to a degree of vacuum of $10^{-7}$ torr. Thereafter, the exhaust pipe is sealed. Note that a getter film (not shown) is formed at a given position in the airtight envelope immediately before or after sealing the envelope in order to maintain the achieved degree of vacuum in the inside of the envelope after being sealed. A getter film is a film of a gettering material containing Ba as principal ingredient typically formed by evaporation by means of a resistance heater or a high frequency heater. The inside of the airtight envelope is maintained to a degree of vacuum between $1\times10^{-5}$ and $1\times10^{-7}$ torr by the adsorption effect of the gettering film.

The display panel of this example had a configuration as described above and was prepared in the above described manner.

Now, the multiple electron beam source of the display panel of this example was prepared in a manner as described below. The multiple electron beam source that can be used for an image-forming apparatus according to the invention may be of any appropriate materials and of an appropriate profile as long as they are surface conduction electron-emitting devices connected with a simple matrix wiring arrangement. Likewise, they may be manufactured by any appropriate method. However, the inventors of the present invention have found that surface conduction electron-emitting devices of which electron-emitting region and its vicinity are formed with a film of fine particles are excellent in the electron emission properties and can be manufactured without difficulty. Therefore, such surface conduction electron-emitting devices are adapted best to the multiple electron beam source of an image-forming apparatus having a large display screen that can display bright and clear images. Thus, surface conduction electron-emitting devices having an electron-emitting region and its vicinity formed by a film of fine particles were used in this example. Therefore, firstly a surface conduction electron-emitting device that can suitably be used for the purpose of the invention will be described in terms of basic configuration and manufacturing method, followed by a description on the structure of a multiple electron beam source comprising a large number of such devices and connected with a simple matrix wiring arrangement.

(Suitable Configuration and Manufacturing Method of a Surface Conduction Electron-emitting Device)

There are two types of surface conduction electron-emitting device having an electron-emitting region and its vicinity formed with a film of fine particles; flat type and step type.

(Flat Type Surface Conduction Electron-emitting Device)

Firstly, the configuration and the manufacturing method of a flat type surface conduction electron-emitting device will be described.

Figure 4A:
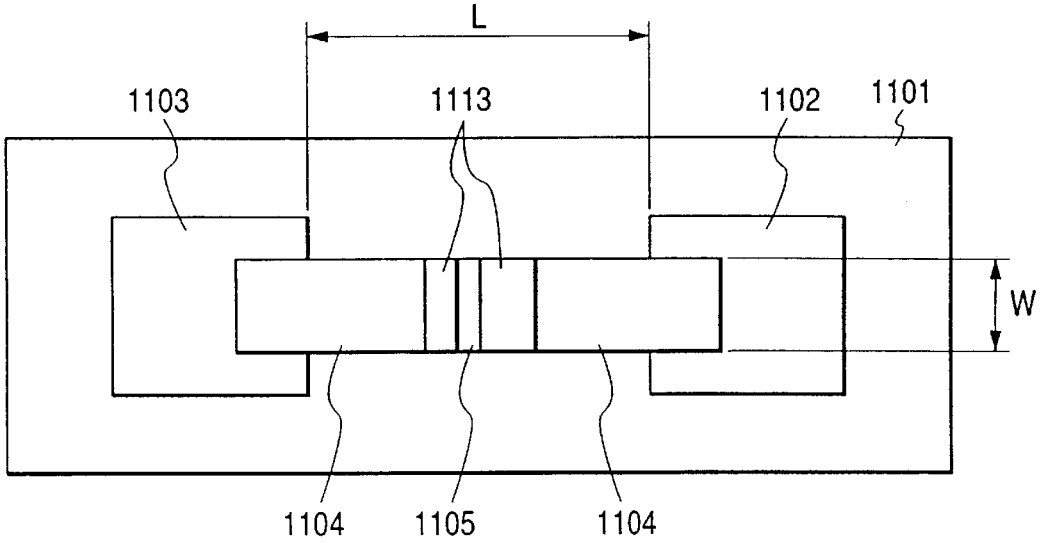
FIGS. 4A and 4B are a schematic plan view and a schematic cross sectional view of a plane type surface conduction electron-emitting device used in Example 1.
Figure 4B:
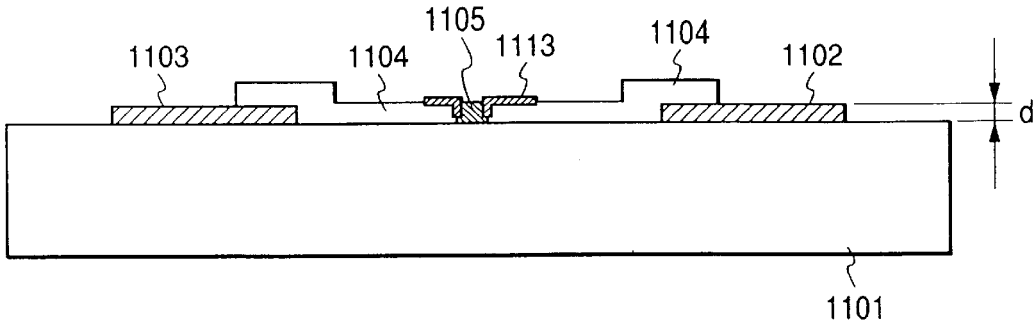

Referring to FIGS. 4A and 4B, showing a plan view (FIG. 4A) and a cross sectional view (FIG. 4B) to schematically illustrate the configuration of a flat type surface conduction electron-emitting device, the device comprises a substrate 1101, a pair of device electrodes 1102 and 1103, an electroconductive thin film 1104, an electron-emitting region 1105 formed by electric energization forming and a thin film 1113 produced by means of an electric energization activation operation.

The substrate 1101 may be a glass substrate made of quartz glass, soda lime glass or some other glass, a ceramic substrate made of alumina or some other ceramic material or a substrate realized by forming an $SiO_2$ layer on any of the above listed substrates.

While the device electrodes 1102 and 1103 arranged oppositely in parallel with each other on the substrate 1101 may be made of any highly conducting material, preferred candidate materials include metals such as Ni, Cr, Au, Mo, W, Pt, Ti, Al, Cu and Pd and their alloys, a metal oxide such as $In_2O_3$—$SnO_2$ and semiconductor materials such as polysilicon. The electrodes may be formed without difficulty by combining a film forming technique such as vacuum deposition and a patterning technique such as photolithography or etching, although some other technique (e.g. printing) may alternatively be used. The device electrodes 1102 and 1103 may be made to have a contour adapted to the application of the electron-emitting device. Generally, the distance L separating the device electrodes is between several hundred angstroms and several hundred micrometers, preferably between several micrometers and tens of several micrometers depending on the voltage to be applied to the device electrodes and the field strength available for electron emission. The film thickness d of the device electrodes is between several hundred angstroms and several micrometers.

The electroconductive thin film 1104 is a film of fine particles. The term a "fine particle film" as used herein refers to a thin film constituted of a large number of fine particles (they may form islands (aggregates)). When observed microscopically, in most cases, fine particles are loosely dispersed, tightly arranged or mutually and randomly overlapping in the film.

The fine particles of a fine particle film typically have a diameter between several angstroms and several thousand angstroms, preferably between 10 angstroms and 200 angstroms. The film thickness of the fine particle film may be selected by taking the following conditions into consideration. Namely, conditions to be met for electrically favorably connecting itself to the device electrodes 1102 and 1103, those to be met for an electric energization forming process and those to be met for making the fine particle film show an appropriate resistance as will be described hereinafter. Specifically, it is between several angstroms and several thousand angstroms, preferably between 10 angstroms and 500 angstroms.

The film of fine particles is made of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The electroconductive thin film 1104 of fine particles as described above is made to show a sheet resistance between $10^3$ and $10^7\Omega/\square$.

Since the electroconductive thin film 1104 and the device electrodes 1102 and 1103 requires an excellent electric connection, they are partly laid one on the other. FIGS. 4A and 4B show that the substrate, the device electrodes, the electroconductive thin film are laid in the above described order to form a multilayer structure. However, they may be laid in the order of the substrate, the electroconductive thin film and the device electrodes alternatively.

The electron-emitting region 1105 is part of the electroconductive thin film 1104 and comprises an electrically highly resistive fissure, although its performance is dependent on the thickness and the material of the electroconductive thin film 1104 and the energization forming process which will be described hereinafter. The electron emitting region 1105 may contain in the fissure electroconductive fine particles having a diameter between several angstroms and several hundred angstroms. The electron-emitting region is only schematically shown in the drawings because there is no way for accurately knowing the location and the profile of the electron-emitting region.

The thin film 1113 is typically made of carbon or a carbon compound and covers the electron-emitting region 1105 and its vicinity. The thin film 1113 is formed as a result of an electric energization activation process conducted after an electric energization forming process as will be described hereinafter.

More specifically, the thin film 1113 is a film of monocrystalline graphite, polycrystalline graphite or noncrystalline carbon or a mixture of any of them having a film thickness less than 500 angstroms, preferably less than 300 angstroms.

Like the electron-emitting region, the thin film 1113 is shown in FIGS. 4A and 4B only schematically because there is no way for accurately knowing its location and profile. Note that the thin film 1113 is partly removed from the plan view of FIG. 4A.

While a surface conduction electron-emitting device is described in terms of preferably configuration and materials. The following materials were used for surface conduction electron-emitting devices in this example.

The substrate 1101 was made of soda lime glass and the device electrodes 1102 and 1103 were made of Ni thin film. The electrodes had a thickness d of 1,000 angstroms and separated by a distance L of 2 $\mu$m.

The fine particle film contained Pb or PdO as principal ingredient and had a film thickness of about 100 angstroms and a width W of about 100 $\mu$m.

Now, a method of manufacturing a flat type surface conduction electron-emitting device will be described.

FIGS. 5A through 5E are schematic cross sectional views of a flat type surface conduction electron-emitting device in different manufacturing steps. Note that the components are denoted by reference symbols the same as those in FIGS. 4A and 4B.

Figure 5A:
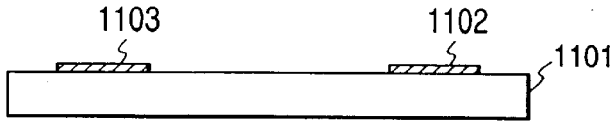
FIGS. 5A, 5B, 5C, 5D and 5E are schematic cross sectional views of a plane type surface conduction electron-emitting device that can be used for the purpose of the invention, showing different manufacturing steps.

1) Firstly, a pair of device electrodes 1102 and 1103 were formed on a substrate 1101 as shown in FIG. 5A.

After thoroughly cleansing a substrate 1101 with detergent and pure water, the material of the device electrodes were deposited on the substrate (by means of evaporation, sputtering or some other appropriate film forming vacuum technique). A pair of device electrodes 1102 and 1103 were then produced from the deposited material by photolithography etching as shown in FIG. 5A.

Figure 5B:
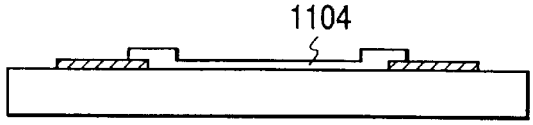
Figure 5C:
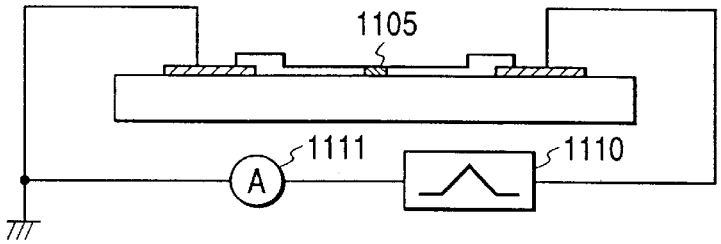

2) Then, an electroconductive thin film 1104 was formed as shown in FIG. 5B.

More specifically, an organic metal thin film is formed on the substrate by applying an organic metal solution and drying the applied solution by heating it. Subsequently, it was processed to form a desired pattern by photolithography etching. For the purpose of the invention, The organic metal solution is a solution of organic metal compound containing as principal ingredient the metal of the fine particle film or the electroconductive thin film. (Pd was used as principal ingredient in this example. While the solution was applied by means of a dipping technique, a spinner or a sprayer may alternatively be used.

The electroconductive thin film of fine particles may alternatively be formed by vacuum deposition, sputtering chemical vapor phase deposition or some other technique.

3) Thereafter, the electroconductive thin film was subjected to an energization forming process by applying an appropriate voltage to the device electrodes 1102 and 1103 from a forming power source 1110 to produce an electron-emitting region 1105. An energization forming process is a process where the electroconductive thin film 1104 of fine particles is electrically energized to produce an electron-emitting region there that shows a modified structure that is different from that of the electroconductive thin film. In other words, the electroconductive thin film is locally and structurally destroyed, deformed or transformed to produce an electron emitting region 1105 as a result of an energization forming process. The electroconductive thin film of fine particles has a fissure in this structurally modified region (electron-emitting region 1105). The electron-emitting region 1105 shows a large electric resistance between the device electrodes 1102 and 1103 if compared with that of the electroconductive thin film where no electron-emitting region 1105 is formed.

Figure 6:
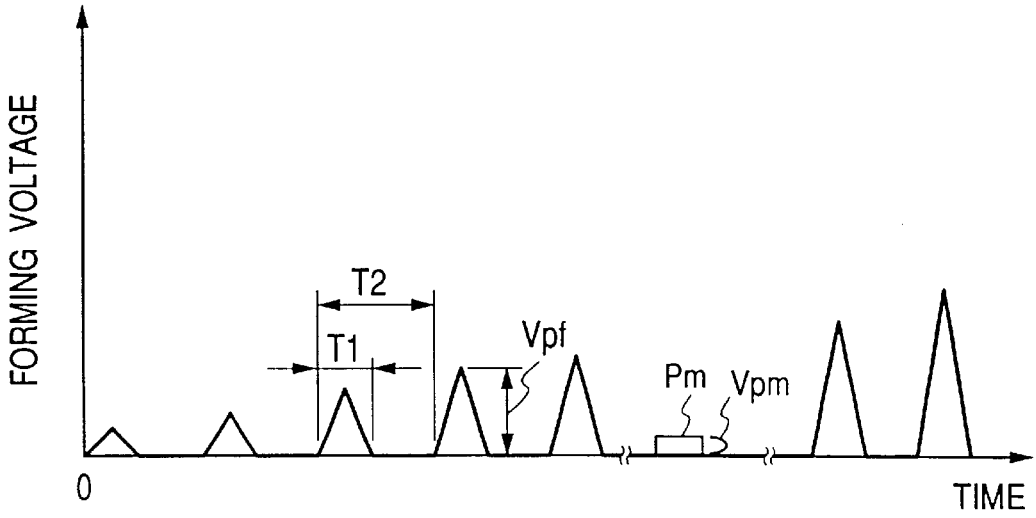
FIG. 6 is a graph schematically showing the waveform of a voltage that can be applied to a surface conduction electron-emitting device in an electric energization forming operation for the purpose of the invention.

To describe the electric energization forming process in greater detail by referring to FIG. 6 showing a voltage waveform that can advantageously be used for the purpose of the invention. A pulse-shaped voltage is advantageously used for conducting a forming operation on an electroconductive film of fine particles. In this example, a triangular pulse voltage having a pulse width T1 and a pulse interval T2 was continuously applied. The wave height Vpf of the triangular pulse was gradually raised. A monitoring pulse Pm was inserted into the intervals of the triangular pulse to monitor the formation of the electron-emitting region 1105, observing the electric current flowing through the device electrodes by means of an ammeter 1111.

In this example, the surface conduction electron-emitting device was placed in vacuum of a degree of about $10^{-5}$ torr and a pulse width T1 of 1 millisecond and a pulse interval T2 of 10 milliseconds were used. The wave height Vpf was raised by 0.1 V for each pulse. A monitoring pulse Pm was inserted by every five triangular pulses. The voltage Vpm of the monitoring pulse was held to as low as 0.1 V in order to avoid any adverse effect of the monitoring pulse on the forming process. The electric energization forming process was terminated when the electric resistance between the device electrodes 1102 and 1103 got to $1\times10^{6}\Omega$ or the electric current observed by the ammeter 1111 fell under $1\times10^{-7}$A while a monitoring pulse was being applied.

While the above described method was advantageous for the surface conduction electron-emitting device of this example, different conditions may have to be selected for the energization forming process when the material and the film thickness of the fine particle film are changed and/or different values are used for the distance L separating the device electrodes and other factors of the surface conduction electron-emitting device.

Figure 5D:
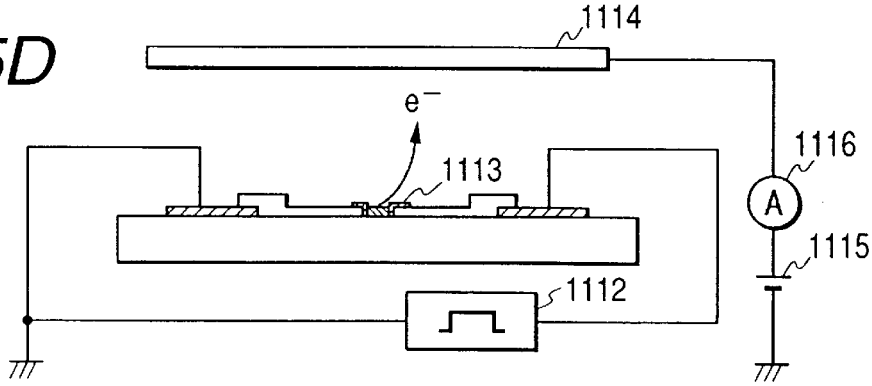

4) Thereafter, the surface conduction electron-emitting device was subjected to an electric energization activation process to improve the performance of the device by applying an appropriate voltage between the device electrodes 1102 and 1103 from an activation power source 1112 as shown in FIG. 5D.

An electric energization activation process is a process where an appropriate voltage is applied to the electron-emitting region 1105 produced as a result of the electric energization forming process in order to deposit carbon or a carbon compound on the region and its vicinity (note that the deposit 1113 of carbon or a carbon compound is shown only schematically in FIG. 5D). After the activation process, the emission current of the surface conduction electron-emitting device rises typically by more than 100 times as compared with the emission current before the process for a same applied voltage.

More specifically, carbon or a carbon compound is deposited on the electron-emitting region as a result of applying a pulse voltage cyclically in vacuum of $10^{-4}$ to $10^{-5}$ torr. The carbon or carbon compound deposit 1113 has its origin in the organic compound remaining in the vacuum and contains monocrystalline graphite, polycrystalline graphite or non-crystalline carbon or a mixture of any of them and has a film thickness less than 500 angstroms, preferably less than 300 angstroms.

Figure 7A:
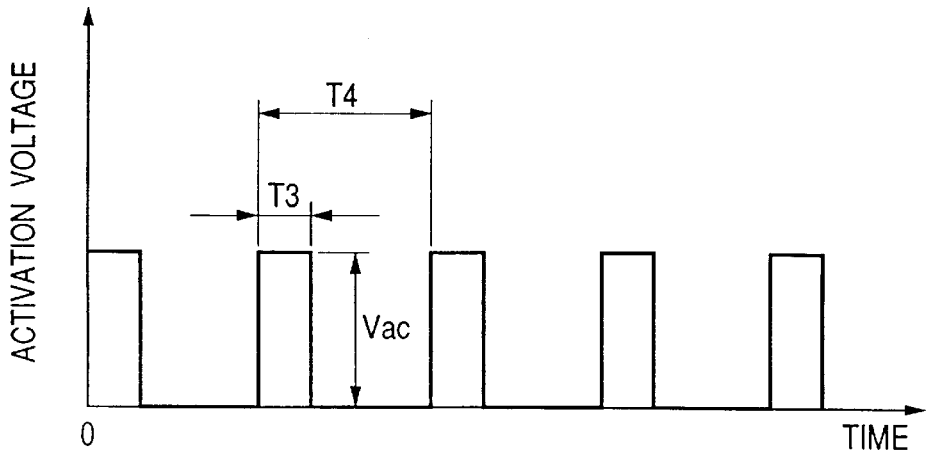
FIGS. 7A and 7B are a graph (FIG. 7A) schematically showing the waveform of voltage that can be applied to a surface conduction electron-emitting device in an energization activation operation for the purpose of the invention and a graph (FIG. 7B) showing the change with time of the emission current Ie of the surface conduction electron-emitting device.

FIG. 7A shows a voltage waveform the activation power source 1112 can provide. The pulse voltage is a regular pulse having a rectangular waveform. More specifically, the voltage Vac of the rectangular pulse was 14 V and the pulse width Te and the pulse interval T4 were respectively 1 millisecond and 10 milliseconds in this example.

While the above values were advantageous for the electric energization activation process of the surface conduction electron-emitting device of this example, different conditions may have to be selected appropriately when the surface conduction electron-emitting device is designed differently.

In FIG. 5D, reference numeral 1114 denotes an anode for capturing the emission current Ie flowing from the surface conduction electron-emitting device, which anode is connected to a high DC voltage source 1115 and an ammeter 1116 (note that the fluorescent surface of the display panel is used as anode 1114 when the activation process is conducted after mounting the substrate 1101 into the display panel).

Figure 7B:
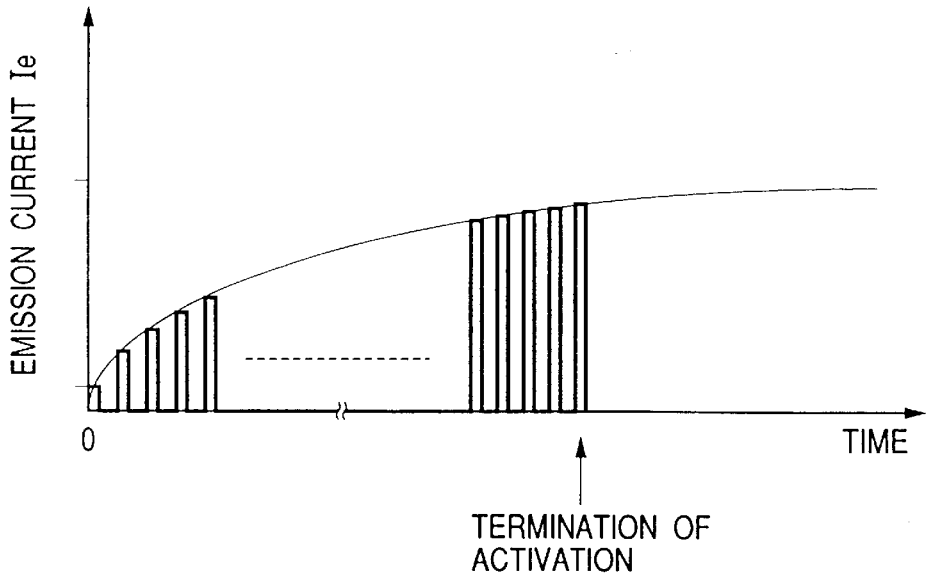

The emission current Ie was observed by the ammeter 1116 to monitor the process of the electric energization activation process and control the operation of the activation power source 1112 while applying the voltage from the activation power source 1112. FIG. 7B shows the emission current Ie observed by the ammeter 1116. As the pulse voltage starts being applied from the activation power source 1112, the emission current Ie rises with time until it gets to a saturated level and does not rise any more. The electric energization activation process will be terminated when the emission current Ie is substantially saturated by suspending the application of the voltage from the activation power source.

Note again that, while the above values were advantageous for the electric energization activation process of the surface conduction electron-emitting device of this example, different conditions may have to be selected appropriately when the surface conduction electron-emitting device is designed differently.

Figure 5E:
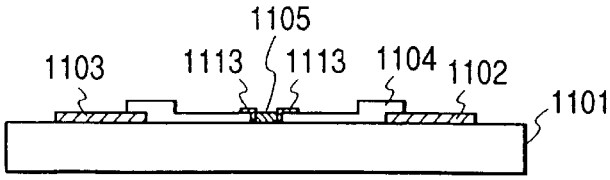

Thus, a flat type surface conduction electron-emitting device as shown in FIG. 5E was prepared.

(Step Type Surface Conduction Electron-emitting Device)

A surface conduction type electron emitting device according to the invention and having an alternative profile, or a step type surface conduction electron-emitting device, and comprising a fine particle film on and around the electron-emitting region will now be described.

Figure 8:
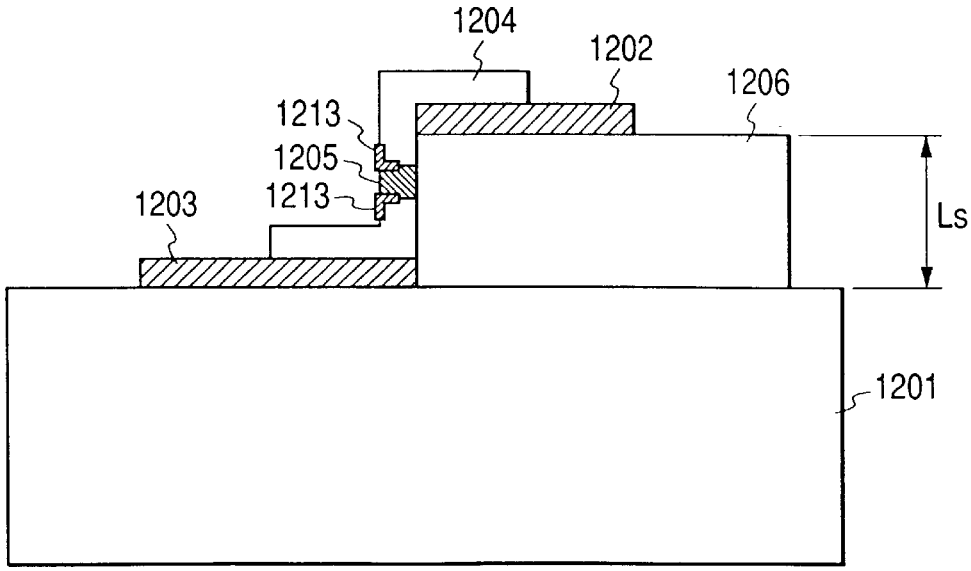
FIG. 8 is a schematic cross sectional view of a step-type surface conduction electron-emitting device used for the purpose of the invention.

FIG. 8 is a schematic sectional side view of a step type surface conduction electron emitting device.

Referring to FIG. 8, the device comprises a substrate 1201, a pair of device electrodes 1202 and 1203, a step-forming section 1206, an electroconductive thin film 1204 of fine particles, an electron emitting region 1205 produced as a result of an electric energization forming process and a thin film 1213 formed by an electric energization activation process.

A step type surface conduction electron-emitting device differs from a flat type surface conduction electron-emitting device as described above in that one of the device electrode 1202 is arranged on the step-forming section 1206 and the electroconductive thin film 1204 covers the lateral surface of the step-forming section 1206. Thus, the distance L separating the device electrodes of the flat type surface conduction electron-emitting device in FIG. 4A corresponds to the height of the step Ls of the step-forming section 1206 of the step type surface conduction electron-emitting device. The substrate 1201, the device electrodes 1202 and 1203 and the electroconductive thin film 1206 of fine particles may be made of the materials described above for the corresponding components of the flat type surface conduction electron-emitting device. Additionally, the step-forming section 1206 is typically made of an electrically insulating material such as $SiO_2$.

FIGS. 9A through 9F are schematic cross sectional views of a step type surface conduction electron-emitting device in different manufacturing steps. Note that the components are denoted by reference symbols same as those in FIG. 8.

Figure 9A:
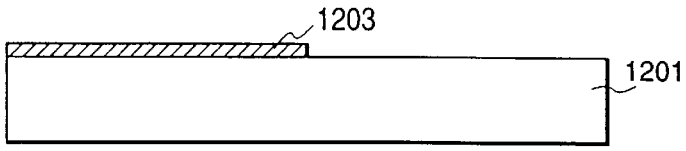
FIGS. 9A, 9B, 9C, 9D, 9E and 9F are schematic cross sectional views of a surface conduction electron-emitting device that can be used for the purpose of the invention, showing different manufacturing steps.
Figure 9B:
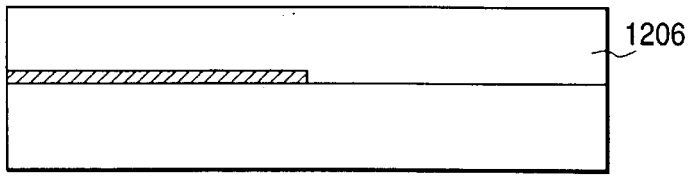
Figure 9C:
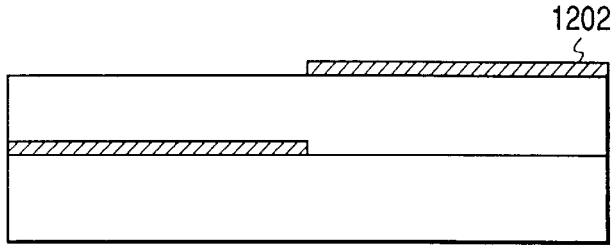
Figure 9D:
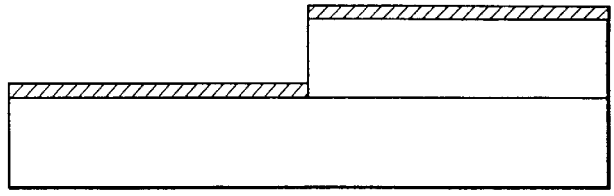
Figure 9E:
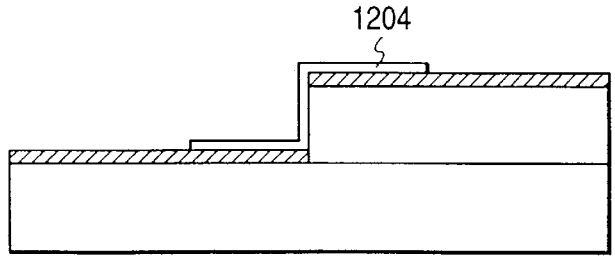

1) Firstly, a device electrode 1203 was formed on a substrate 1201 as shown in FIG. 9A.
2) Then, an insulation layer was laid for the step-forming section as shown in FIG. 9B. The insulation layer may be formed by sputtering $SiO_2$ or some other film forming technique such as vacuum evaporation or printing.
3) Another device electrode 1202 was formed on the insulating layer as shown in FIG. 9C.
4) Then, as shown in FIG. 9D, the insulating layer was partly removed typically by etching to expose the device electrode 1203.
5) Thereafter, an electroconductive thin film 1204 of fine particles was formed as shown in FIG. 9E typically by means of an application method as used for the flat type surface conduction electron-emitting device.
6) The electroconductive thin film was subjected to an electric energization forming process as that of the flat type surface conduction electron-emitting device (as described above by referring to FIG. 5C).
7) The electroconductive thin film now having an electron-emitting region was subjected to an electric energization activation process to deposit carbon or a carbon compound on and around the electron-emitting region (as described above by referring to FIG. 5D).

Figure 9F:
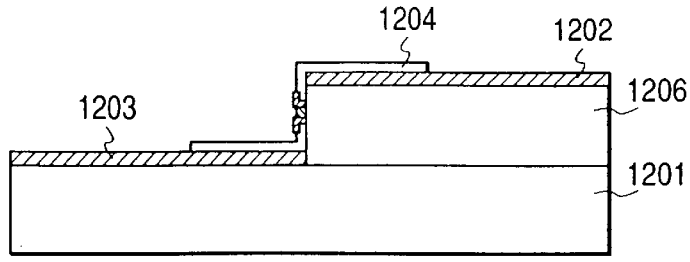

Thus, a step type surface conduction electron-emitting device as shown in FIG. 9F was prepared.

(Characteristics of the Surface Conduction Electron-emitting Devices Used For a Display Apparatus)

Now the performance of the surface conduction electron-emitting devices of flat type and of step type produced as described above will be describe when used in a display apparatus.

Figure 10:
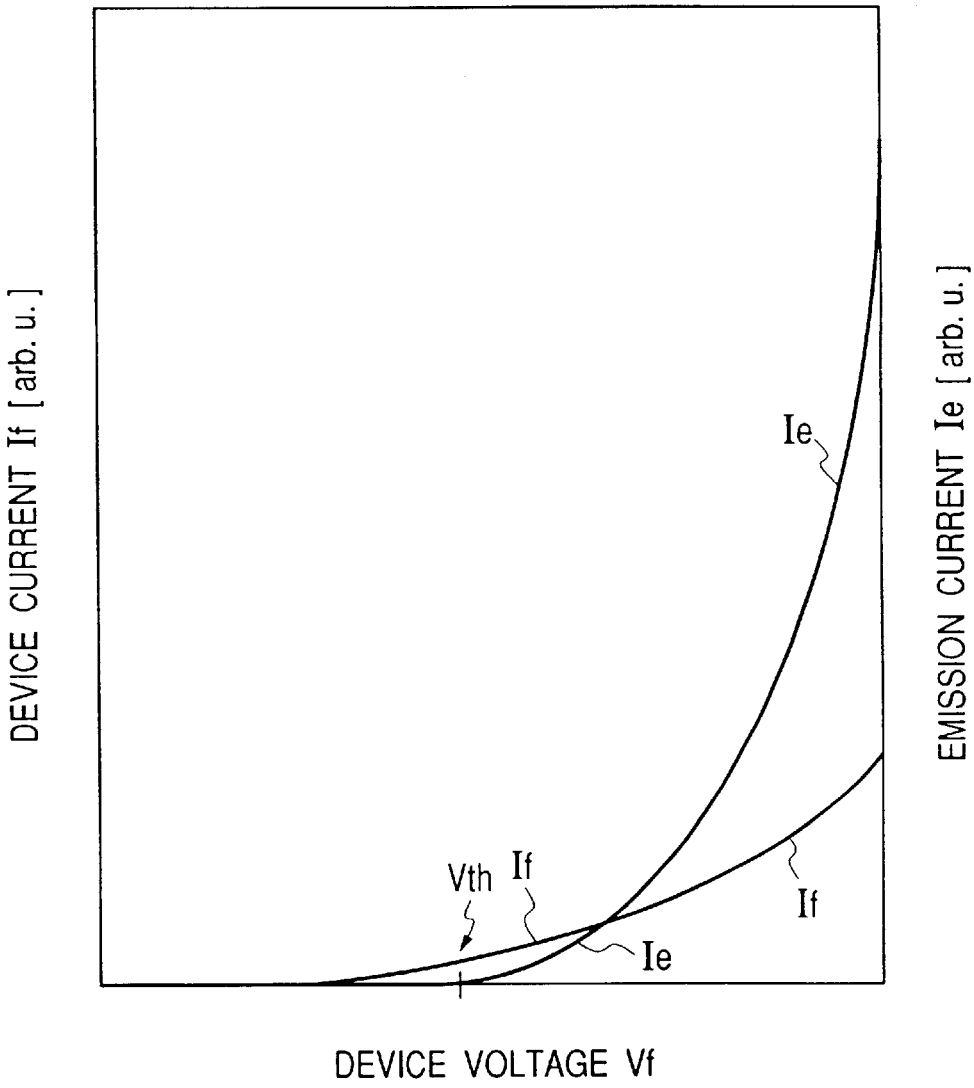
FIG. 10 is a graph showing the typical characteristics of the operation of a surface conduction electron-emitting device that can be used for the purpose of the invention.

FIG. 10 shows a graph schematically illustrating typical characteristics of a surface conduction electron-emitting device in the relationship between the emission current Ie and the voltage Vf applied to the device, and between the device current If and the voltage Vf applied to the device. Note that different units are arbitrarily selected for Ie and If in FIG. 10 in view of the fact that Ie has a magnitude far smaller than that of If.

As seen in FIG. 10, an electron-emitting device that can be used for a display apparatus has three remarkable features in terms of emission current Ie, which will be described below.

Firstly, the surface conduction electron-emitting device shows a sudden and sharp increase in the emission current Ie with an applied voltage above a certain level (which is referred to as a threshold voltage Vth hereinafter), whereas the emission current Ie is practically undetectable with an applied voltage lower than Vth.

Differently stated, the electron-emitting device is a non-linear device having a clear threshold voltage Vth to the emission current Ie.

Secondly, since the emission current Ie changes according to the voltage applied to the device (Vf), the former can be effectively controlled by way of the latter.

Thirdly, the emitted electric charge amount can be controlled by the duration of time of application of the device voltage Vf, because of the quick response of the electric current Ie generated from the device to the voltage Vf applied to the device.

Because of the above remarkable features, a display apparatus could be prepared by advantageously using such surface conduction electron-emitting devices. For instance, with a display apparatus comprising a large number of devices arranged to correspond to the respective pixels on the display screen, images can be displayed by sequentially scanning the screen on the basis of the first characteristic feature of the devices. A voltage exceeding the threshold voltage Vth will be applied to each of the devices being driven depending on the desired luminance produced by the device, while a voltage lower than the threshold voltage Vth will be applied to all the unselected devices. Thus, images can be displayed by sequentially scanning the display screen, sequentially selecting the device to be driven.

The second and third characteristic features can be exploited to control the luminance and hence the color tone of the pixels corresponding to the selected electron-emitting device.

(Configuration of a Multiple Electron Beam Source Comprising a Large Number of Devices Provided With a Simple Matrix Wiring Arrangement)

A multiple electron beam source comprising surface conduction electron-emitting devices arranged on a substrate and provided with a simple matrix wiring arrangement will be described below.

Figure 11:
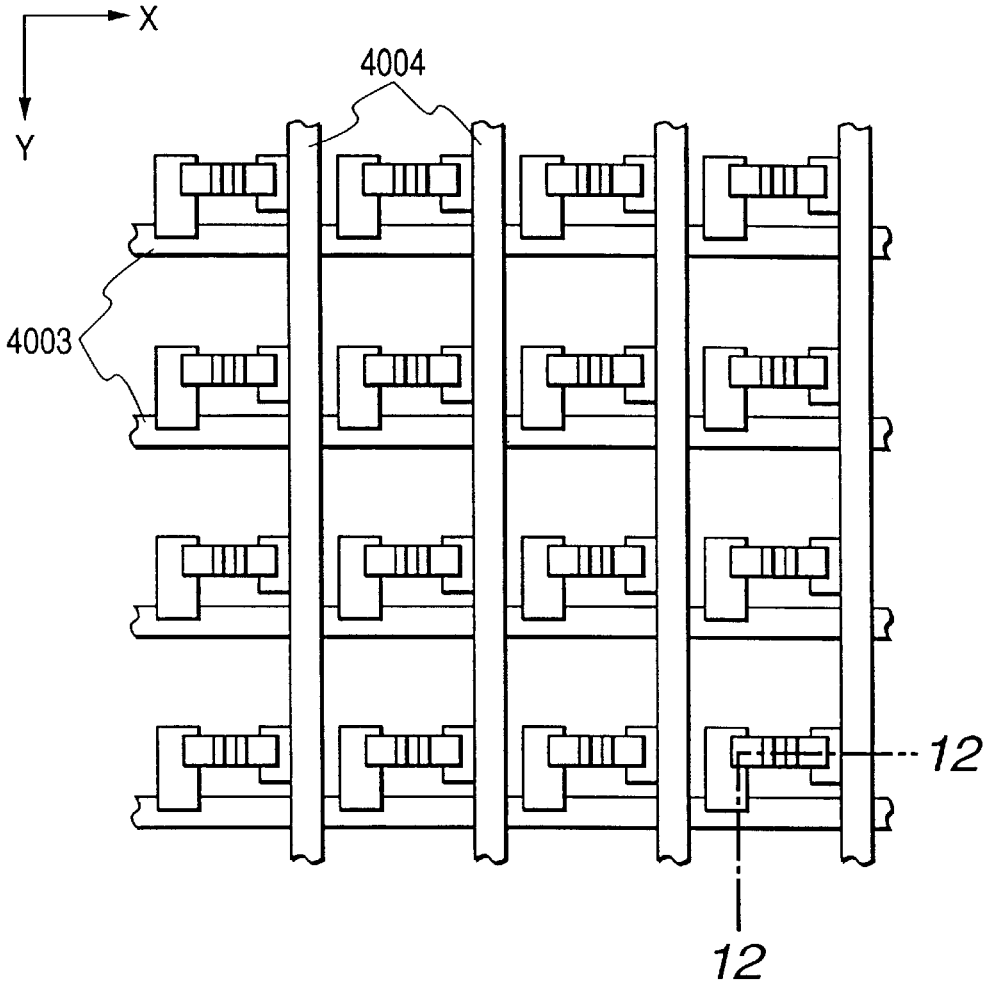
FIG. 11 is a schematic plan view of the multiple electron beam source that can be used for the purpose of the invention.

FIG. 11 is a schematic plan view of a multiple electron beam source used for the display panel of FIG. 2. A plurality of electron-emitting devices are arranged in rows and columns and provided with a simple matrix wiring arrangement using row-directional electrodes 4003 and column-directional electrodes 4004. An insulation layer (not shown) is formed between the electrodes at the crossings of the row-directional electrodes 4003 and the column-directional electrodes 4004 for electric insulation.

Figure 12:
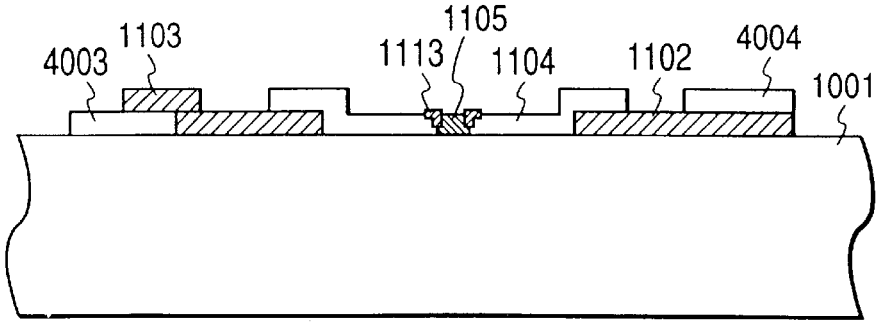
FIG. 12 is a schematic partial cross sectional view of the electron beam source of FIG. 11 taken along line 12—12 in FIG. 11.

FIG. 12 is a schematic cross sectional view of the multiple electron beam source taken along line 12—12 in FIG. 11.

The multiple electron beam source was prepared by forming the row-directional electrodes 4003, the column-directional electrodes 4004, the inter-electrode insulation layer (not shown) and the device electrodes and the electroconductive thin films of the surface conduction electron-emitting devices on a substrate and subjecting the devices to an electric energization forming process and then to an electric energization activation process by feeding the devices with electricity by way of the respective row-directional electrodes 4003 and the column-directional electrodes 4004.

Reference Example

For the purpose of reference, an image-forming apparatus comprising a 3 mm or 40 mm thick face plate of soda lime glass provided with an anti-charge film on the outer surface but not with a protector plate or a potential interlocking electroconductive layer was prepared and driven to operate for 48 hours in an atmosphere of 70° C. and 75% relative humidity by applying a high voltage (10 kV), with the image-forming apparatus of Example 1. Table 1 below shows some of the obtained results. It will be seen that the image-forming apparatus of Example 1 is thin and light-weight but can display high quality images that would not be degraded with time.

Additionally, the human body can touch the image-forming apparatus of Example 1 without any risk of being hurt because it is provided with a current limiting means that can secure the safety on the part of the human body.

TABLE 1

| | Example 1 | Ref. Example 2 | Ref. Example 3 |
|---|---|---|---|
| thickness of face plate (inc. protector plate) | 7 mm | 3 mm | 40 mm |
| degradation of image due degradation to Na migration | no degradation | degradation noticeable | no |
| weight of face plate (inc. protector plate) | light | light (about 0.7 times of Example 1) | heavy (about 9 times of Example 1) |

EXAMPLE 2

Figure 13A:
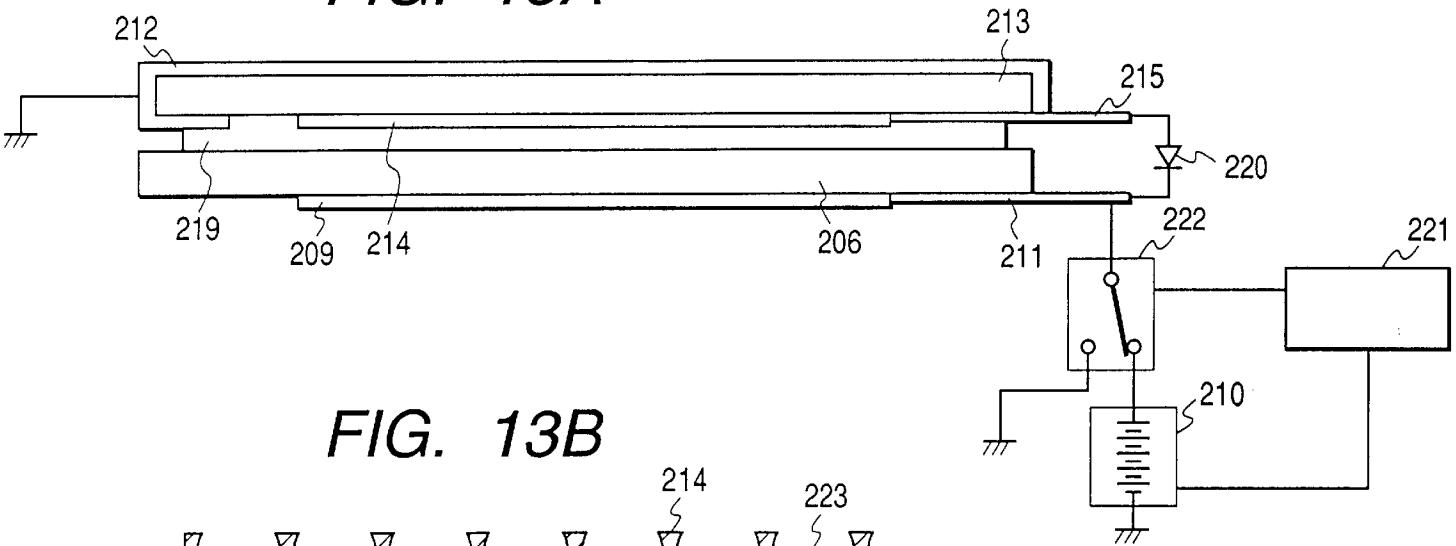
FIGS. 13A and 13B are a schematic illustration of Example 2 (FIG. 13A) and a schematic view of the mesh electrode used for the potential interlocking electroconductive layer in Example 2 (FIG. 13B)
Figure 13B:
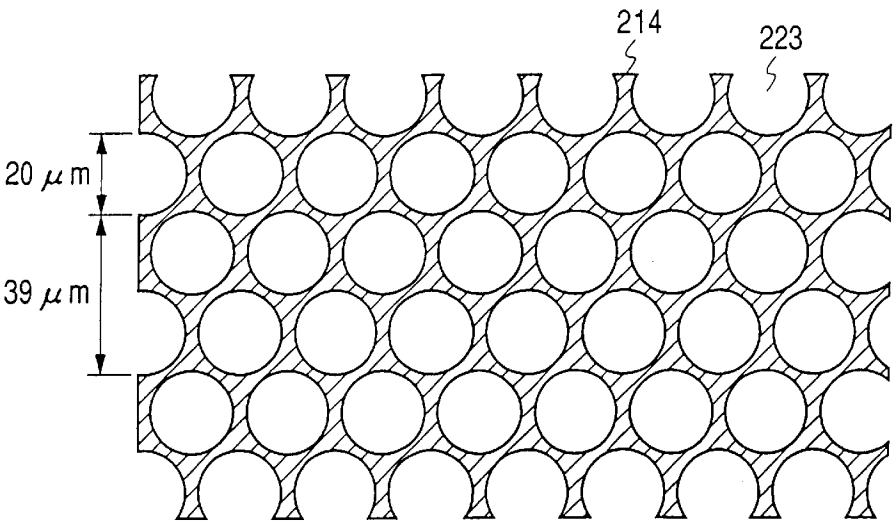

FIGS. 13A and 13B show the image-forming apparatus of Example 2.

A fluorescent layer (not shown) was formed to a thickness of about 20 $\mu$m on the inner surface of a 3 mm thick face plate of soda lime glass 206 and a metal back layer 209 was formed to cover the fluorescent layer to a thickness of about 1,000 angstroms. The high voltage lead-in terminal 211 was connected to the metal back 209. The high voltage lead-in terminal 211 was further connected to the output terminal of a switch 222. The switch 222 is controlled by a controller 221 to select either a high voltage source 210 with an output voltage of 10 kV or the ground and connect it to the high voltage lead-in terminal 211.

A multiple electron beam source the same as that of Example 1 was used. In the drawings, reference numeral 213 denotes a 3 mm thick protector plate of polycarbonate on the surface of which an anti-charge film 212 of transparent and electroconductive ITO was formed by vacuum evaporation. The electric potential of the anti-charge film 212 was held to that of the ground to prevent the surface from being electrically charged.

A potential interlocking electroconductive layer 214 was formed on the opposite surface of the face plate to reduce the optical reflectivity of the protector plate side at least to less than 1%. In this example, the potential interlocking electroconductive layer 214 was made of carbon paste and provided with a number of apertures 223 having a diameter of 20 $\mu$m and arranged at a pitch as shown in the drawings (with a numerical aperture of 70%).

The potential interlocking layer 214 was connected to the switch 222 by way of the drawn-out wire 215 and a diode 220. The operation of the switch and the output of the high voltage source were controlled by the controller 221 such that the output of the high voltage source was turned off and the switch 222 was connected to the ground when a detection means as will be described hereinafter detected the risk that the potential interlocking layer 214 was exposed to the outside when the cabinet was opened.

As the potential interlocking layer 214 and the high voltage source 210 were connected by the diode 220 arranged in a manner as shown in FIG. 13A, the electric potential of the potential interlocking layer 214 was made to be equal to the output potential of the high voltage source due to the reversing effect of the diode when the switch 222 was connected to the high voltage source 210.

Figure 20:
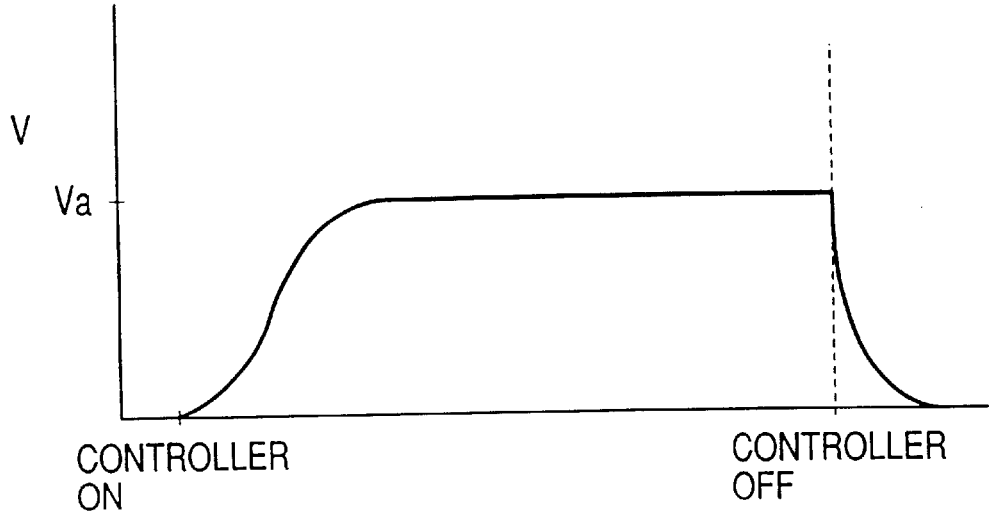
FIG. 20 is a graph schematically showing the change in the potential of a potential interlocking electroconductive layer that can be used for the purpose of the invention.

FIG. 20 shows how the electric potential of the potential interlocking layer changes as a function of the ON/OFF operation of the high voltage source. In this example, it was brought to the potential of the high voltage source within several minutes as a reverse current of about 10 $\mu$A was provided by the diode. This means that, if the human body touches the potential interlocking layer by chance, the reverse current of the diode limits the electric current that can flow into the human body to keep the latter safe and sound.

When the high voltage source was turned off by the controller 221, the electric potential of the potential interlocking layer 214 followed the electric potential of the high voltage source due to the effect of the forward current of the diode 220 so that the electric charge of the potential interlocking layer 214 could not remain there for a prolonged period of time, making the image-forming apparatus safer to the human body.

The protector plate 213 was rigidly secured to the glass face plate 206 by means of a photohardening type adhesive agent 219. The refractive index of the protector plate 213 was 1.56, that of the glass face plate 206 was 1.51 and that of the adhesive agent after hardening was 1.54, which was found between the above two refractive indexes. Thus, the optical reflectivity at any of the interfaces was less than 1% without requiring any reflectionless treatment.

A photohardening type adhesive agent was used for securing the protector plate 213 to the glass face plate 206 because it could simplify the manufacturing process. The protector plate 213 was placed in position after applying the adhesive agent to the face plate 206. Then, the adhesive agent was hardened by beams of light entering it through the protector plate 213.

As shown in FIG. 13A, the anti-charge film 212 was turned and laid on the layer of the adhesive agent (note that FIG. 13A is a cross sectional view showing the drawn-out wire 215 and hence the anti-charge film 212 is not partly laid on the layer of the adhesive agent, although it is laid on all the area of the layer of the adhesive agent except the drawn-out wire 215 and its vicinity). With this arrangement, the high voltage applying electrode and the surface area having a high electric potential were protected against being exposed to the outside.

Figure 22:
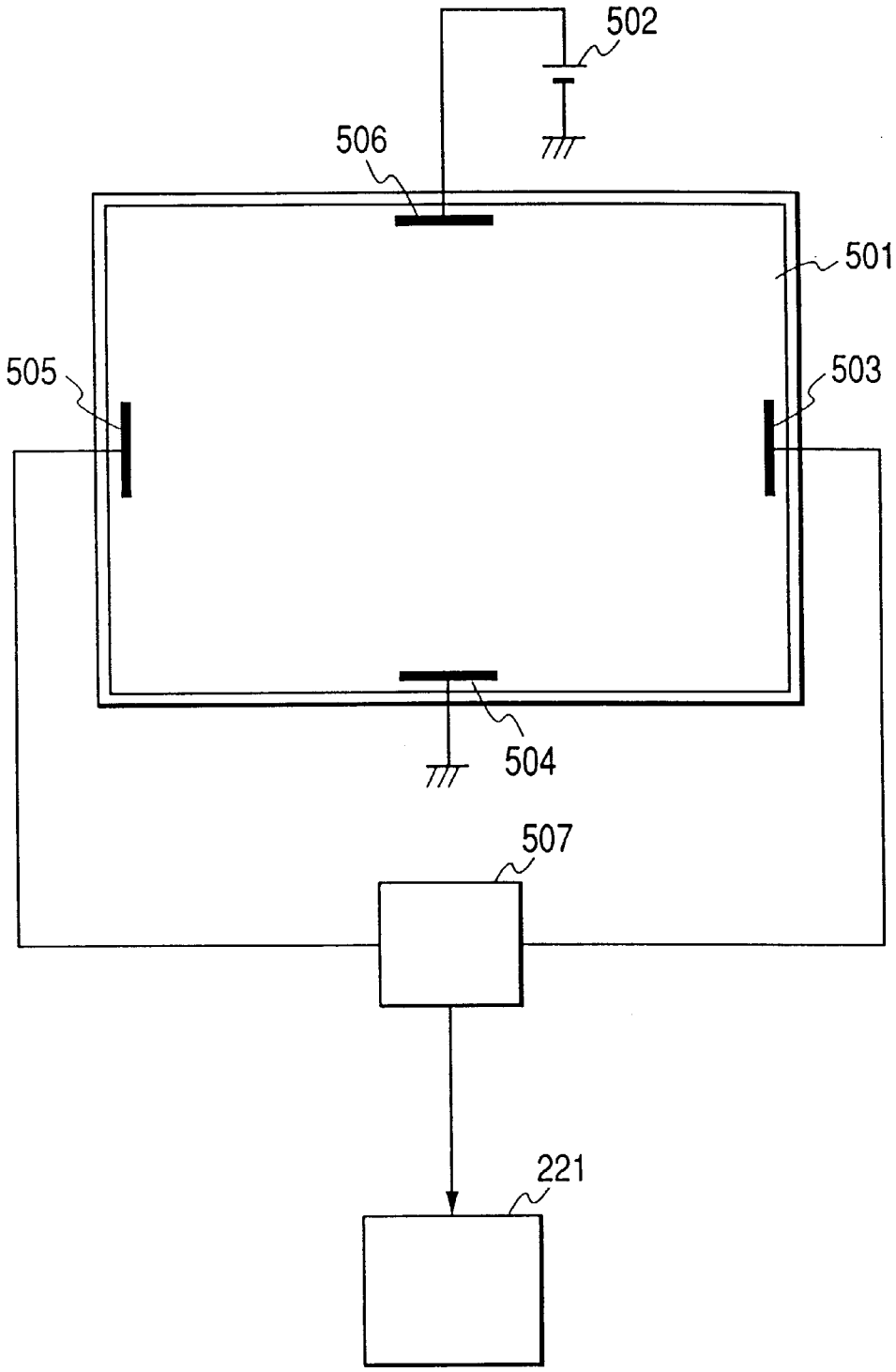
FIG. 22 is a schematic circuit diagram of an interlock switch that can be used for the purpose of the invention.

In this example, an interlock switch was arranged as means for detecting any opened condition of the cabinet and hence an exposed condition of the potential interlocking layer 214. Additionally, a means for detecting the destruction of the protector layer was provided to detect the possibility of an exposed potential interlocking layer 214 in a case when the cabinet is opened other than ordinary disassembling. More specifically, as shown in FIG. 22, a total of four electrodes 503 through 506 were arranged along the periphery of the anti-charge film 501, of which the electrode 504 was grounded and the electrode 506 was connected to a power source 502 with an output voltage of 10 V. A minute current detecting circuit 507 was connected between the electrodes 503 and 505. The electrodes 503 through 506 were arranged at the middle points of the respective edges of the anti-charge film 501 symmetrically relative to each other. During the normal operation of the apparatus, no electric current flows between the electrodes 503 and 505 but, if the protector plate is damaged as a crack appeared on it, the minute current detecting circuit 507 detects any electric current that can flow due to the damage and notifies the controller 221 of the risk where the potential interlocking layer can be exposed.

While the anti-charge film was used as destruction detecting electrode in this example, an electrode exclusively dedicated to the detection of damages may alternatively be arranged. Still alternatively, the interlocking layer may be used as destruction detecting electrode.

The image-forming apparatus of this example was driven to operate for 48 hours in an atmosphere of 70° C. and 85% relative humidity by applying a high voltage (10 kV) to prove that the quality of the displayed image was free from degradation. Additionally, the image-forming apparatus of Example 2 was thin and lightweight. Still additionally, the human body can touch the image-forming apparatus of Example 2 without any risk of being hurt because the potential interlocking layer is provided with a current limiting means that can secure the safety on the part of the human body.

Since the potential interlocking layer 214 has an optical transmissivity of 70%, it can reduce the reflection of light getting to the fluorescent film by more than a half to improve the contrast of the displayed image.

The potential interlocking layer provides the effect of blocking any electromagnetic waves leaking from the cathode ray tube system to prevent them from adversely affecting the human body and the equipment surrounding it.

EXAMPLE 3

Figure 14:
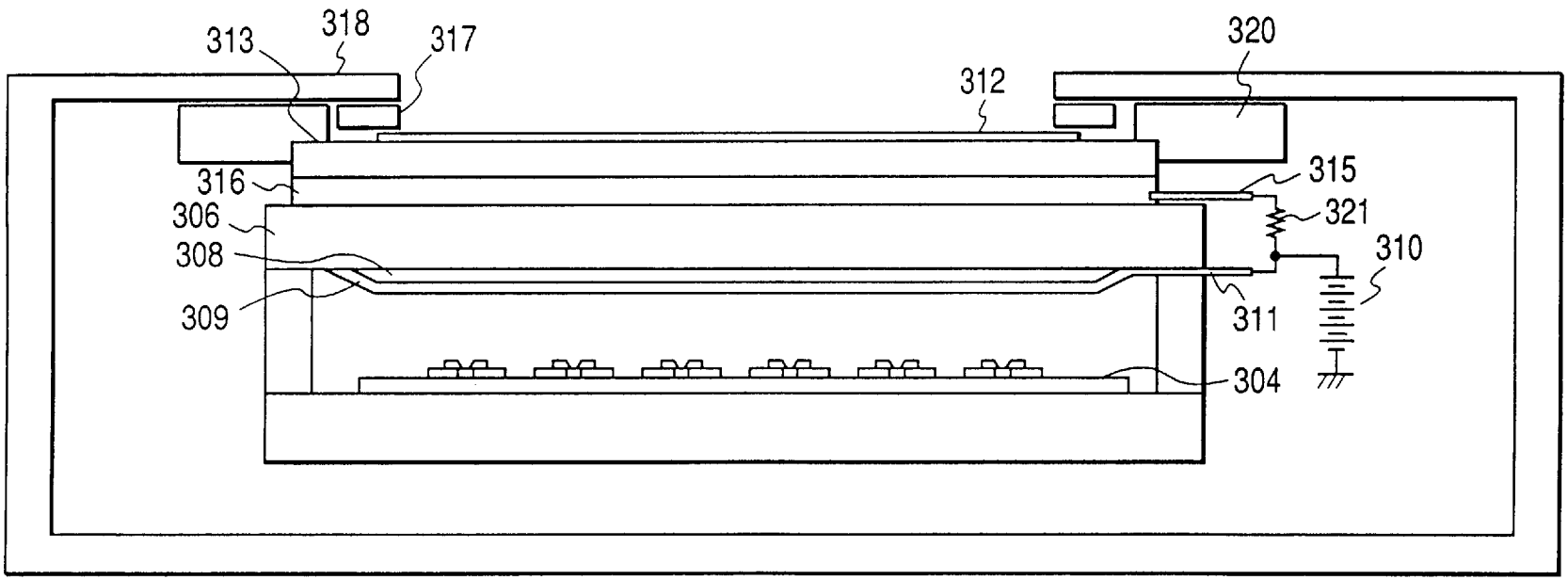
FIG. 14 is a schematic illustration of Example 3.

Now, Example 3 will be described by referring to FIG. 14.

A fluorescent layer 308 was formed to a thickness of about 20 m on the inner surface of a face plate of soda lime glass 306 and a metal back layer 309 was formed to cover the fluorescent layer to a thickness of about 1,000 angstroms. A high voltage lead-in terminal 311 was connected to the metal back 309. The high voltage lead-in terminal 311 was further connected to a high voltage source 310 of an output voltage of 10 kV.

A drawn-out wire 315 was extending from a layer of a transparent electroconductive adhesive agent 316 and connected to the high voltage source 310 by way of a resistor 321 of $10^7\Omega$. Thus, the potential interlocking layer does not do any harm to the human body when touched, since the electric current is suppressed to 1 mA although the apparatus is driven by the high voltage of 10 kV.

A rear plate 304 carrying thereon an electron source having a simple matrix wiring arrangement same as that of Example 1 was also used in this example.

Reference numeral 313 denotes an protector plate made of polycarbonate and processed to show a coarse surface for an anti-glaring effect. An anti-charge film 312, an electroconductive transparent ITO film, was formed on the surface of the protector plate by evaporation so that the protector plate was held to the electric potential of the anti-charge film 312 and hence the surface was prevented from being electrically charged. The anti-charge film 312 was electrically connected to the cabinet 318 by means of pieces of electroconductive rubber 317 and the cabinet 318 was grounded. Thus, the electric potential of the surface of the protector plate was held to that of the ground and protected against electric charges.

The protector plate 313 was secured to glass face plate 306 by means of a transparent electroconductive adhesive agent 316 and the layer of the transparent electroconductive adhesive agent 316 serves as potential interlocking layer in this example.

The refractive index of the protector plate 313 was 1.56, that of the glass face plate 306 was 1.51 and that of the adhesive agent after hardening was 1.54, intermediate of the above two refractive indexes. Thus, the optical reflectivity at any of the interfaces was less than 1% without requiring any reflectionless treatment. The layer of the transparent electroconductive adhesive agent 316 was made of a photohardening type adhesive agent into which ITO fine particles had been dispersed.

The interface of the electroconductive rubber 317 and the cabinet 318 was surrounded by insulating rubber 320. Thus, the length of the interface of the layer of the transparent electroconductive adhesive 316 and the anti-charge film 312 or the cabinet 318 was extended to further prevent any undesired electric discharges from taking place there.

The image-forming apparatus of this example was driven to operate for 48 hours in an atmosphere of 70° C. and 85% relative humidity by applying a high voltage (10 kV) to prove that the quality of the displayed image was free from degradation. Additionally, the image-forming apparatus of this example was thin and lightweight. Still additionally, the human body can touch the layer of the electroconductive adhesive agent 316 of this example without any risk of being hurt because an current limiting resistor 321 was inserted.

EXAMPLE 4

Figure 15:
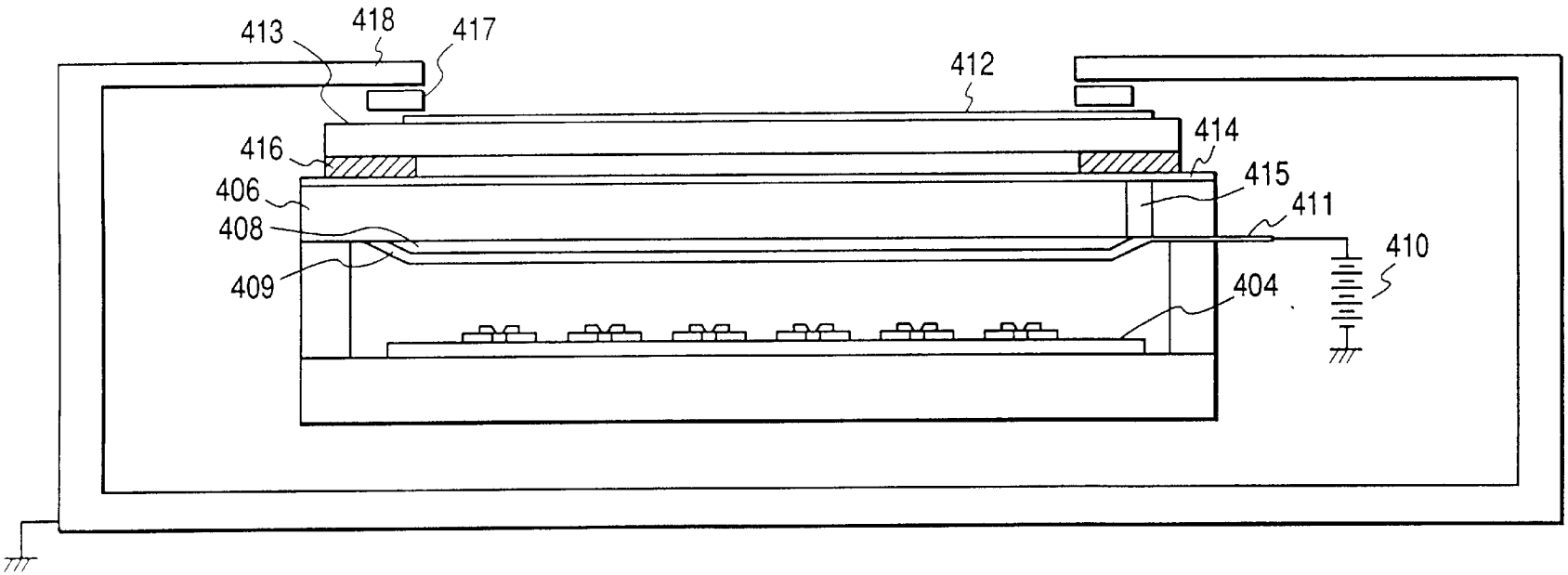
FIG. 15 is a schematic illustration of Example 4
Figure 16:
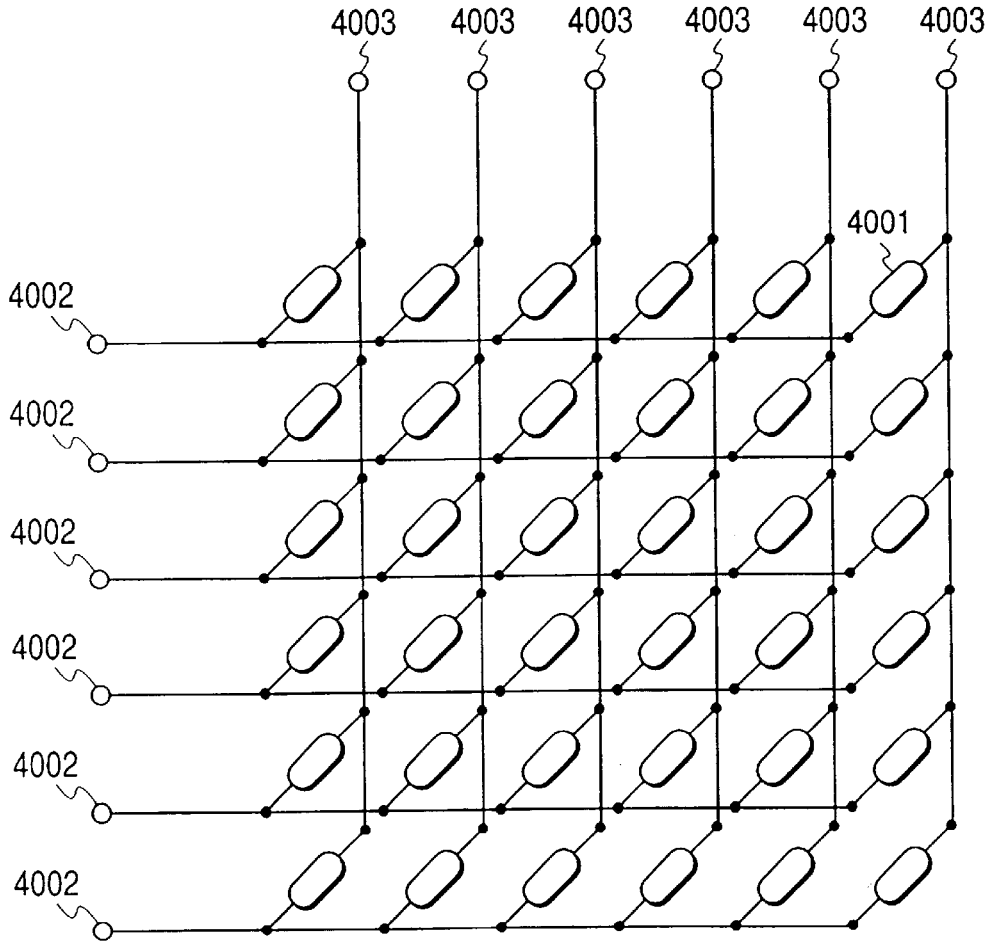
FIG. 16 (PRIOR ART)
FIG. 16 is a schematic illustration of surface conduction electron-emitting devices provided with a matrix wiring arrangement.
Figure 17:
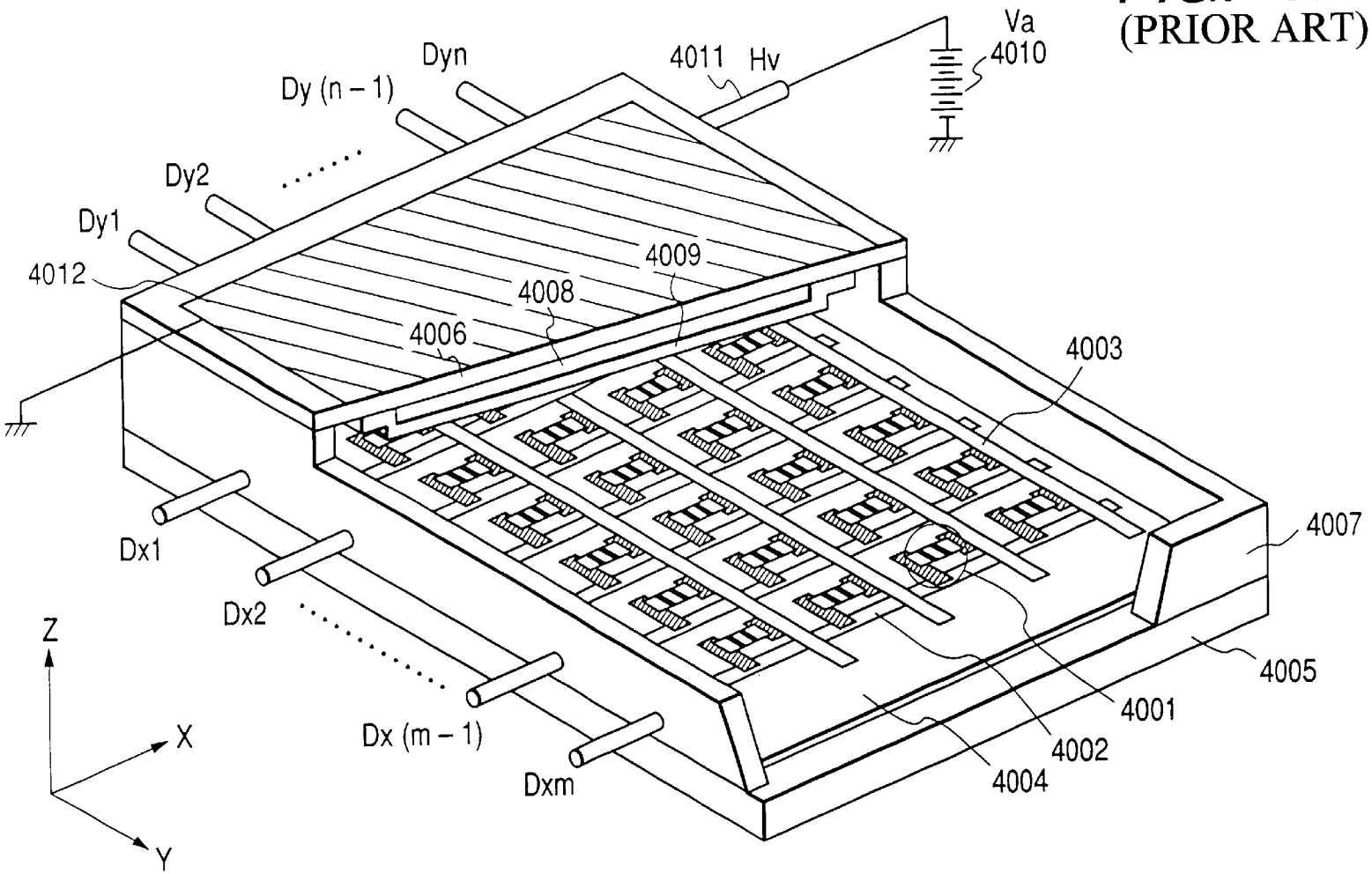
FIG. 17 (PRIOR ART)
FIG. 17 is a schematic perspective view of a known image-forming apparatus, showing the inside by partly cutting out the display panel.
Figure 18:
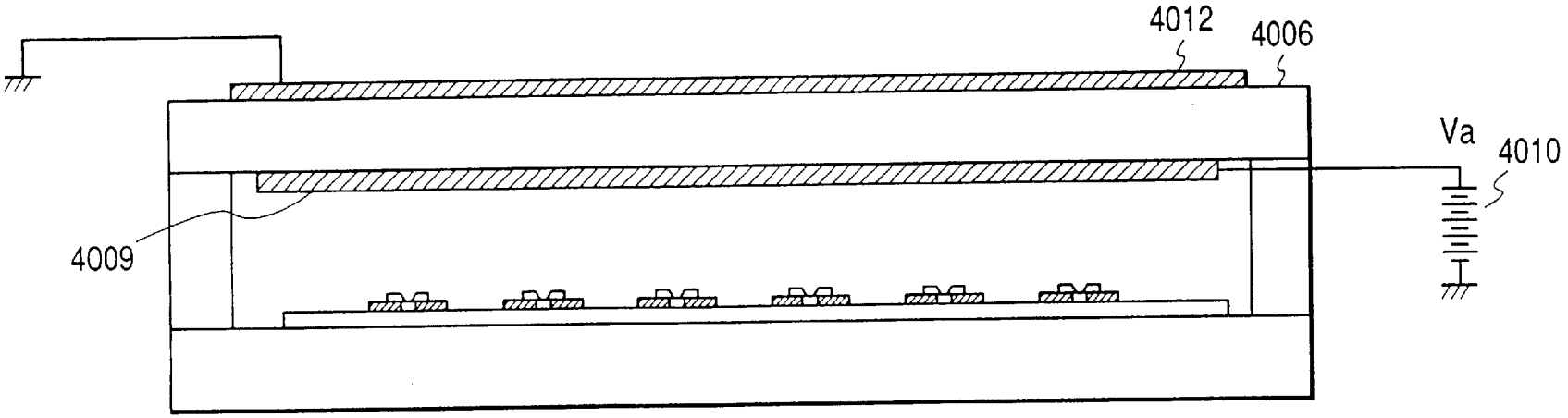
FIG. 18 (PRIOR ART)
FIG. 18 is a schematic illustration of a known face plate.

Now, Example 4 will be described by referring to FIG. 15.

A fluorescent layer 408 was formed to a thickness of about 20 $\mu$m on the inner surface of a face plate of soda lime glass 406 and a metal back layer 409 was formed to cover the fluorescent layer to a thickness of about 2,000 angstroms. A high voltage lead-in terminal 411 was connected to the metal back 409. A potential interlocking electroconductive layer 414 that was an ITO transparent electroconductive film was formed on the other surface of the face plate by evaporation. the potential interlocking electroconductive layer 414 was connected to the aluminum metal back 409 by way of an electroconductive via hole 415 having a resistance of r through the face plate 406. The high voltage lead-in terminal 411 is also connected to a high voltage source 410 with an output voltage of 10 kV so that a high voltage can be applied to both the aluminum metal back 409 and the potential interlocking electroconductive layer 414.

A rear plate 404 provided with an electron source having a simple matrix wiring arrangement same as the one used in Example 1 was also used in this example.

Reference numeral 413 denotes a protector plate made of polycarbonate and coated with an anti-charge and anti-reflection multilayer film 412 having an evaporated ITO transparent electroconductive film as the outermost layer. The potential interlocking electroconductive layer 414 and the anti-charge film 412 may be made of a material other than evaporated ITO. For instance, they may be formed by applying an evaporated film of tin oxide or indium oxide or a solution containing the oxide and then heating the film or the solution. The resistance r of the via hole 415 was so selected that it was sufficiently small relative to the resistance R between the anti-charge film 412 and the potential interlocking electroconductive layer 414 so that Vf was made very close to Va when Rg=r in equation (2) and a sufficiently small time constant was obtained by equation (3). More specifically, in this example, the resistance r was $10^7\Omega$. Thus, only a voltage less than 1 V was applied to the face plate 406 when 10 kV was applied to the high voltage lead-in terminal 411. If the human body touches the potential interlocking layer 414, it will not be hurt because only an electric current less than 1 mA flows there.

The anti-charge film 412 was connected to the cabinet 418 by means of pieces of electroconductive rubber 417 and the cabinet 418 was grounded. Thus, the potential of the surface of the protector plate was held to that of the ground and prevented from being electrically charged. The protector plate 413 was rigidly held to the glass face plate 406 at the periphery thereof by a layer of an adhesive agent 416. While a high voltage is applied to the potential interlocking electroconductive layer 414, dust gathering will be prevented by hermetically sealing it.

The image-forming apparatus of this example was driven to operate for 48 hours in an atmosphere of 70 C. and 85% relative humidity by applying a high voltage (10 kV) to prove that the quality of the displayed image was free from degradation. Additionally, the image-forming apparatus of this example was thin and lightweight. Still additionally, the human body can touch the potential interlocking electroconductive layer of this example without any risk of being hurt because an current limiting resistor was inserted.

While the protector plate of this example was made of acryl or polycarbonate, it may be made of any other appropriate material such as polypropylene (PP) or polyethylene-terephthalate (PET).

While surface conduction electron-emitting devices were used for the electron source of the above examples, they may be replaced by Spindt type or MIM type cold cathode devices.

While the voltage applied to the face plate is in the order of several hundred volts, the present invention may effectively be applied to a plasma display where the sodium deposition on the surface is accelerated due to the heat emitted from the inside.

As described above in detail, an image-forming apparatus according to the invention comprises a face plate typically made of soda lime glass and carrying a cathode ray target to which a high voltage is applied, a transparent protector plate having an electroconductive anti-charge film layer on the surface, a potential interlocking electroconductive layer arranged between the face plate and the protector plate and a means for interlocking the electric potential of the electroconductive layer with the high voltage applied to the cathode ray target so that the electric potential of the potential interlocking electroconductive layer can be held to a level equal to or lower than the voltage applied to the cathode ray target and hence the migration of Na ions within the face plate can be suppressed to prevent any reduction in the optical transmissivity. Thus, the image-forming apparatus is free from the problem of degraded image quality if driven for a prolonged period of time. Additionally, it can be dimensionally reduced and manufactured at low cost.

Finally, the electric current that can be drawn out of the potential interlocking layer is limited to secure the safety of the human body touching it by chance.

What is claimed is:

1. An image-display apparatus comprising:

an envelope;

a fluorescent layer and an anode electrode arranged within said envelope and disposed on an inner surface of said envelope;

an electron source arranged within said envelope, said electron source radiating said fluorescent layer with electrons; and a transparent plate having an outer surface coated with an electroconductive film, said transparent plate being spaced from an outer surface of said envelope, with a space between the outer surface of said envelope and said transparent plate, the outer surface of said envelope being on an opposite side of the inner surface of said envelope, and said electroconductive film being grounded.

2. The image-display apparatus according to claim 1, wherein said electron source comprises a cold cathode type electron-emitting device.

3. The image-display apparatus according to claim 1, wherein said electron source comprises a surface conduction electron-emitting device.

4. A flat plate type image-display apparatus comprising:

an envelope comprising a face plate and a spaced rear plate;

a fluorescent layer and an anode electrode arranged within said envelope and disposed on an inner surface of said face plate of said envelope;

an electron source arranged within said envelope, said electron source radiating said fluorescent layer with electrons; and a transparent plate having an outer surface coated with an electroconductive film, said transparent plate being spaced from an outer surface of said face plate, with a space between an outer surface of said envelope and said transparent plate, the outer surface of said face plate being on an opposite side of the inner surface of said face plate, and said electroconductive film being grounded.

5. The image-display apparatus according to claim 4, wherein said electron source comprises a cold cathode type electron-emitting device.

6. The image-display apparatus according to claim 4, wherein said electron source comprises a surface conduction electron-emitting device.

7. An image-display apparatus comprising:

an envelope;

a fluorescent layer and an anode electrode arranged within said envelope and disposed on an inner surface of said envelope;

an electron source arranged within said envelope, said electron source comprising a plurality of electron-emitting devices arranged in a matrix, with said electron source radiating said fluorescent layer with electrons; and a transparent plate having an outer surface coated with an electroconductive film, said transparent plate being spaced from an outer surface of said envelope, with a space between the outer surface of said envelope and said transparent plate, the outer surface of said envelope being on an opposite side of the inner surface of said envelope, and said electroconductive film being grounded.

8. The image-display apparatus according to claim 7, wherein said electron-emitting devices are arranged along a plurality of rows and columns.

9. The image-display apparatus according to claim 8, wherein said electron-emitting devices are cold cathode type electron-emitting devices.

10. The image-display apparatus according to claim 8, wherein said electron-emitting devices are surface conduction electron-emitting devices.

11. A flat plate type image-display apparatus comprising:

an envelope comprising a face plate and a spaced rear plate;

a fluorescent layer and an anode electrode arranged within said envelope and disposed on an inner surface of said face plate of said envelope;

an electron source arranged within said envelope, said electron source comprising a plurality of electron-emitting devices arranged in a matrix, with said electron source radiating said fluorescent layer with electrons; and a transparent plate having an outer surface coated with an electroconductive film, said transparent plate being spaced from an outer surface of said face plate of said envelope, with a space between the outer surface of said envelope and said transparent plate, the outer surface of said face plate being on an opposite side of the inner surface of said face plate, and said electroconductive film being grounded.

12. The image-display apparatus according to claim 11, wherein said electron-emitting devices are arranged along a plurality of rows and columns in a matrix.

13. The image-display apparatus according to claim 12, wherein said electron-emitting devices are cold cathode type electron-emitting devices.

14. The image-display apparatus according to claim 12, wherein said electron-emitting devices are surface conduction electron-emitting devices.

* * * * *

UNITED STATES PATENT AND TRADEMARK OFFICE

CERTIFICATE OF CORRECTION

PATENT NO. : 6,831,619 B2
DATED : December 14, 2004
INVENTOR(S) : Yasuyuki Todokoro It is certified that error appears in the above-identified patent and that said Letters Patent is hereby corrected as shown below:

Column 7,
Line 27, “lay” should read -- ray --.
Line 62, “1009.” should read -- 1009. ¶ A transparent potential interlocking layer 1014 of ITO is formed on the surface of the face plate by vacuum evaporation. --.

Column 12,
Line 50, “While a” should read -- A --.
Line 58, “Pb” should read -- Pd --.

Column 21,
Line 48, “70 C.” should read -- 70°C --.

Signed and Sealed this

Eighteenth Day of October, 2005

JON W. DUDAS
*Director of the United States Patent and Trademark Office*